United States Patent [19]

Fukumoto et al.

[11] 4,000,581

[45] Jan. 4, 1977

[54] VEHICLE WINDOW REGULATOR MECHANISM

[75] Inventors: Ryoichi Fukumoto, Nagoya; Masatoshi Fujita, Kariya, both of Japan

[73] Assignee: Aisin Seiki Kabushiki Kaisha, Kariya, Japan

[22] Filed: July 21, 1975

[21] Appl. No.: 597,736

[30] Foreign Application Priority Data

| | | |
|---|---|---|
| July 23, 1974 | Japan | 49-84391 |
| July 24, 1974 | Japan | 49-84916 |
| July 30, 1974 | Japan | 49-87226 |

[52] U.S. Cl. ..... 49/103; 49/349; 49/351

[51] Int. Cl.[2] ..... E05F 5/12

[58] Field of Search ..... 49f/103, 349, 227, 351

[56] References Cited

UNITED STATES PATENTS

| | | | |
|---|---|---|---|
| 2,955,817 | 10/1960 | Campbell et al. | 49/227 X |
| 3,733,748 | 5/1973 | Heesch | 49/103 |
| 3,745,703 | 7/1973 | Francis et al. | 49/103 |

*Primary Examiner*—Kenneth Downey
*Attorney, Agent, or Firm*—Sughure, Rothwell, Mion, Zinn & Macpeak

[57] ABSTRACT

A vehicle window regulator mechanism for lowering and raising two glass sections of a vehicle window comprises a pair of first and second regulator arms on which are supported a vent glass and a main glass, respectively, a sector gear pivotally mounted on a vehicle base plate member and operatively connected to the two arms, and a plurality of cam slots and cam followers operatively connecting the two arms with the sector gear and the vehicle base plate. The two glasses may be sequentially or simultaneously lowered and raised due to different arrangements between the cam slots and the cam followers upon rotational movement of the sector gear.

5 Claims, 29 Drawing Figures

VEHICLE WINDOW REGULATOR MECHANISM

BACKGROUND OF THE INVENTION

1. Field of the Invention

This invention relates generally to vehicle window regulators, and more particularly to a vehicle window regulator for a window divided into two sections i.e., a small ventilation section and a large visibility section.

2. Description of the Prior Art

A conventional window regulator of the above type is disclosed in U.S. Pat. No. 3,745,703 patented on July 17, 1973, in which the vent glass 13 and the main glass 14 are independently lowered and raised relative to the window opening. However, this prior art regulator can lower the vent glass only prior to the lowering of the main glass and can raise the vent glass only after the raising of the main glass has been carried out.

SUMMARY OF THE INVENTION

The present invention provides a vehicle window regulator mechanism for a window divided into a vent glass section and a main glass section which is capable of raising and lowering the vent glass section and the main glass section sequentially or simultaneously.

The present invention provides a vehicle window regulator mechanism of the type having a base plate secured to the vehicle door, a sector gear pivotally mounted upon said base plate, a drive pinion gear for rotating the sector gear about the axis thereof, a first regulator arm pivotally mounted upon said base plate and supporting a first vent window glass section, a second regulator on pivotally mounted upon said base plate and supporting a second main window glass section, a plurality of cam slots provided in said base plate and said sector gear comprising a first cam slot provided in said sector gear and having a straight inclined section radially directed toward the pivot axis of said sector gear and an arcuate section continuous with said straight incline section and being concentric to the pivot axis of said sector gear, a second cam slot provided in said sector gear and a third cam slot provided in said base plate, first and second cam followers, a link member having one end pivotally mounted on one end of said second regulator arm, said first cam follower secured to said first regulator arm intermediate the end of said first regulator arm and moveably disposed in said first cam slot, said second cam follower secured to the other end of said link member and moveably disposed in said second and third cam slots whereby upon rotation of said sector gear said first cam follower rotates said first regulator arm by travelling in said first cam slot to lower or raise the first vent window glass supported on said first regulator arm while said second cam follower rotates said second regulator arm through said link member by travelling in said second and third cam slots to lower or raise the second main window glass supported on said second regulator arm independently of the first window glass. The foregoing and other objects features and advantegous of the present invention will be apparent from the following more particular description of preferred embodiments of the invention as illustrated in the accompanying drawings.

BRIEF DESCRIPTION OF THE DRAWINGS

FIG. 12 is the position of second cam follower 23.);

DESCRIPTION OF THE FIRST EMBODIMENT: (FIGS. 1–5)

Figure 1:
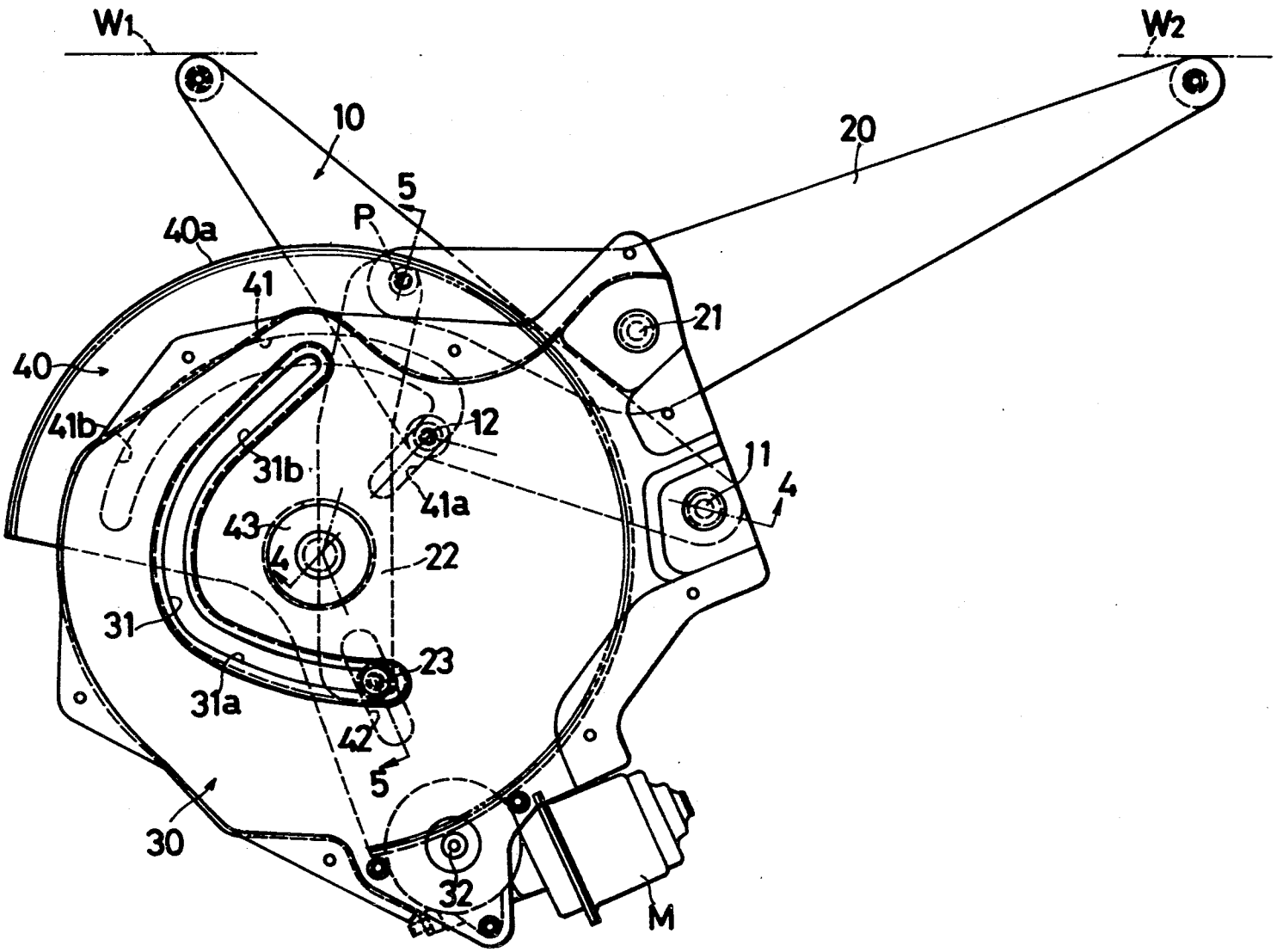
FIG. 1 is a perspective view of a vehicle window regulator mechanism of a first embodiment of this invention showing two glasses $W_1$ and $W_2$ being fully raised.

Numeral 10 designates a first regulator arm one end of which supports a small vent glass $W_1$ and the other end of which is pivotally mounted on a base plate 30 through a pivot pin 11. The first regulator arm 10 further includes a first cam follower 12 secured thereto at an intermediate portion. This first cam follower 12 is disposed in a first cam slot 41 provided in a gear sector 40 whereby pivotal movement of the first regulator arm 10 will be controlled by the first cam follower 12 and the first cam slot 41 relationship, as will be explained later in detail.

Numeral 20 designates a second regulator arm, one end of which supports a large main glass $W_2$ and the other end of which is pivotally connected to one end of a link member 22 through a pivot pin P. The small vent glass $W_1$ is moveable in substantially coplanar relationship to this large main glass $W_2$. The second regulator arm 20 is swingable intermediate its ends on a pivot pin 21 journalled on the base plate 30. At the other end of the link member 22 is provided a second cam follower 23 which is disposed in a second cam slot 42 and a third cam slot 31 provided respectively in the gear sector 40 and the base plate 30 whereby pivotal movement of the second arm 20 about the pivot pin 21 will be controlled by the relationship of the second cam follower 23 and the second and the third cam slots 42, 31, as will also be explained later in detail.

The base plate 30, on which are mounted all of the regulator mechanisms, is secured to an appropriate portion of a vehicle door (not shown) preferably inside thereof. The gear sector 40 is pivotally mounted on the base plate 30 through a pivot shaft 43. The gear sector 40 at the outer periphery thereof is provided with a gear toothed portion 40a which is in mesh with a pinion gear 32 rotatably mounted on the base plate 30. A motor M is also secured to the base plate 30 for driving the pinion gear 32 to actuate the gear sector 40.

Referring now to the particular programming of the cam followers and cam slots the following movements will occur upon operation of the regulator. The first cam slot 41 on the gear sector 40 comprises a straight inclined section 41a extending radially toward the pivot axis 43 of the sector gear 40 and an arcuate section 41b connected to and extending from the straight inclined section 41a and being concentric about the pivot axis 43 of the sector gear 40. When the first cam follower 12 is in the straight inclined section 41a it will rotate the first regulator arm 10 about its pivot axis 11 by coaction between the cam follower 12 and the walls of the straight inclined section 41a upon rotational movement of the sector gear 40, and when the first cam follower 12 is in the arcuate section **41*b*, it will not rotate the first regulator arm 10 about axis 11 even upon rotational movement of the sector gear 40 since the follow 12 will always remain at the same radial distance from the pivot axis 43 of the sector gear 40**.

The second cam slot 42 on the gear sector 40 consists of a straight slot in which the second cam follower 23 is disposed. This slot 42 is disposed radially toward the pivot axis 43 of the sector gear 40 and is adapted to transmitting the rotational torque from the sector gear 40 to the link member 22 through the second cam follower 23.

The third cam slot 31 on the base plate 30 comprises an arcuate section **31*a* having a constant radial distance from the pivot P of the link member 22 when the main glass $W_2$ is closed as viewed in FIG. 1 and a curved section 31*b* which merges with the arcuate section 31*a*. The curved section 31b extends from the arcuate section 31*a* toward the pivot axis P of the link member 22. Thus, when the second cam follower 23 is in the arcuate section 31a, the link member 22 is rotatable about the axis P of the link member 22, and accordingly no movement of the second regulator arm 20 will occur even when the sector gear 40 is driven. However, when the second cam follower 23 is in the curved section 31*b*, the link member 22 is forced to move upwardly upon rotation of the sector gear 40, since the second cam follower 23 is forced to move along the curved section 31*b* by coaction between the walls of the second cam slot 42 and the second cam follower 23 as well as coaction between the walls of the curved section 31*b* of the third cam slot 31 and the second cam follower 23**.

The position shown in FIG. 1 illustrates both of the glasses $W_1$ and $W_2$ being fully raised. From this position, the window glasses may be lowered by actuating the motor M to rotate the pinion gear 32 in a counter-clockwise direction as viewed in FIG. 1. This counter-clockwise rotation of the pinion gear 32 drives the sector gear 40 in a clockwise direction about the axis 43. As the sector gear 40 begins to rotate the clockwise direction, it causes relative movement between the first cam follower 12 and the first cam slot 41 as well as between the second cam follower 23 and the second and third cam slots 42 and 31. The relative movement between the first cam follower 12 and the first cam slot 41, especially in that phase of the movement in which the first cam follower 12 is in the straight inclined section 41a results in the first regulator arm 10 being rotated in a counter-clockwise direction about the axis 11, which causes the small vent glass $W_1$ to be lowered. At this time, the second cam follower 23 moves along the arcuate section **31*a* of the third cam slot 31, being forced by the walls of the second cam slot 42. No movement of the main glass $W_2$ occurs at this time, because the link member 22 rotates about the axis P without causing any movement of the second regulator arm 20**.

Figure 2:
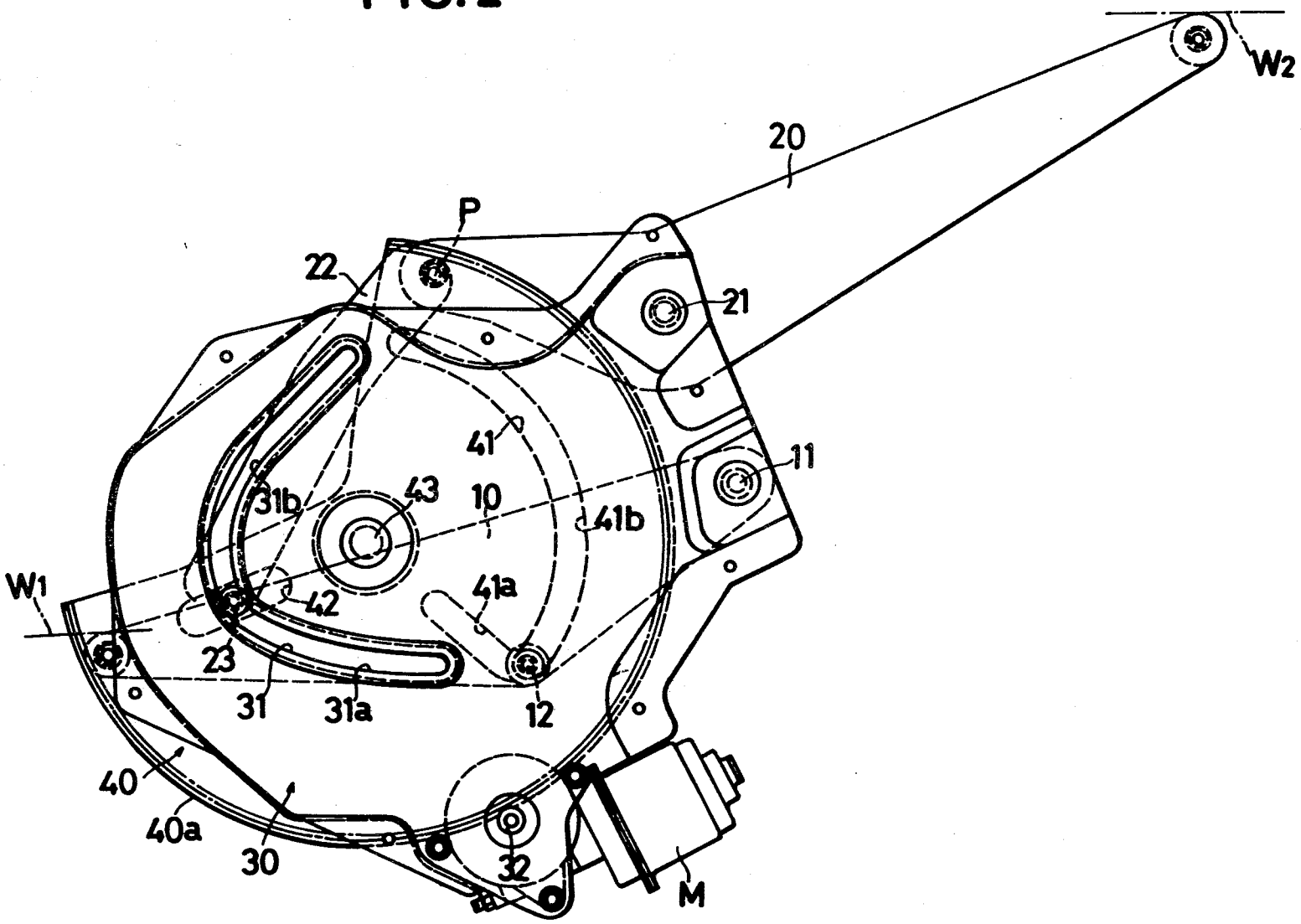
FIG. 2 is a view similar to FIG. 1 but showing a lowered position of the vent glass $W_1$.

As the rotation of the sector gear 40 is continued, the rotational movement of the first regulator arm 10 continues and the second regulator arm 20 remains stationary until the first cam follower 12 is removed to the arcuate section **41*b* of the first cam slot 41 and the second cam follower 23 is removed to the curved section 31b of the third cam slot 31 as shown in FIG. 2. The vent glass $W_1$ is completely or fully lowered when the first regulator arm 10 is positioned as shown in FIG. 2**.

From this position, as the rotation of the sector gear 40 is further continued, the second phase of operation starts between the cam followers and the cam slots.

In the second phase, no further rotation of the first arm 10 occurs since the arcuate section **41*b* of the first cam slot 41 is concentric about the axis 43 and is thus unable to influence the first cam follower 12 moving therein. However, the second cam follower 23 is, at this time, forced to move along the curved section 31***b* of the third cam slot 31 by coaction between the walls of the second cam slot 42 and the curved section 31*b* and the second cam follower 23, causing the link member 22 to move upwardly as is shown in FIG. 3.

This upward movement of the link member 22 causes the rotation of the second regulator arm 20 about the pivot axis 21 in a clockwise direction. The main glass $W_2$ supported on the second regulator arm 20 is accordingly lowered. When the second cam follower 23 reaches to the uppermost end of the curved slot 31*b*, the main glass $W_2$ is positioned at its lowermost position.

Figure 3:
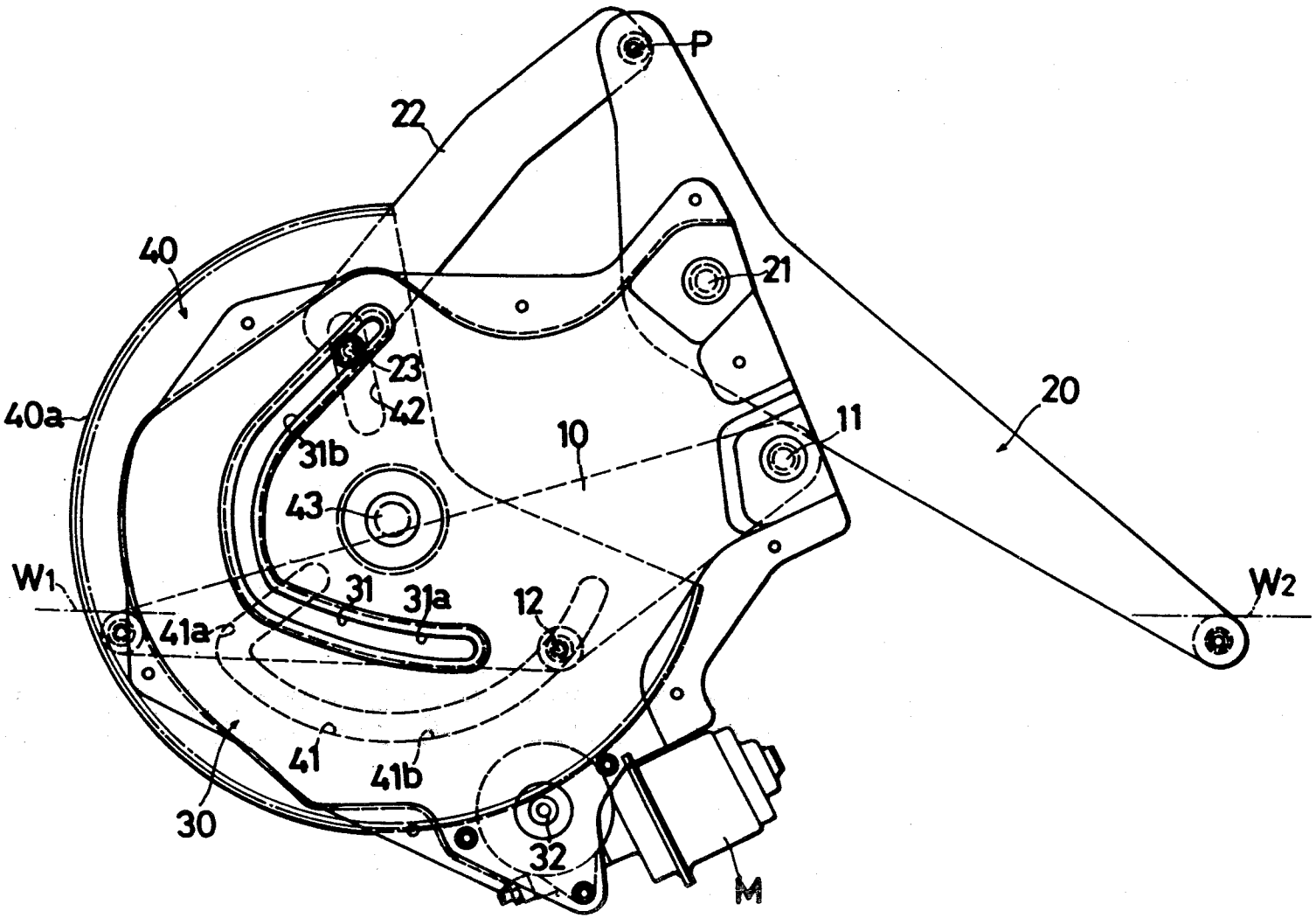
FIG. 3 is a view similar to FIG. 2 but showing both of the glasses $W_1$ and $W_2$ being fully lowered.
Figure 4:
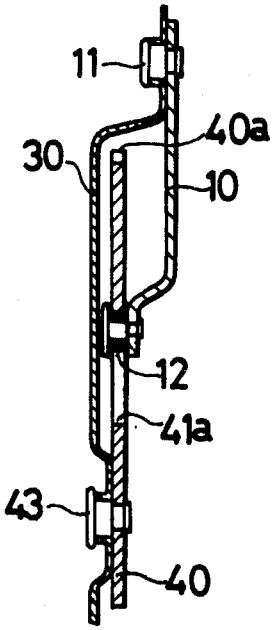
FIG. 4 is a cross-sectional view taken along the line 4—4 of FIG. 1.
Figure 5:
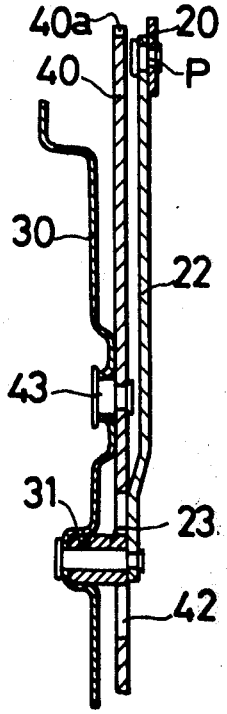
FIG. 5 is a cross-sectional view taken along the line 5—5 of FIG. 1.

To raise the glasses $W_1$ and $W_2$ from the position in FIG. 3, the motor M is actuated to rotate the pinion gear 32 in a clockwise direction as viewed in FIG. 3. This clockwise rotation of the pinion gear 32 causes the rotation of the sector gear 40 in a counter-clockwise direction. The second cam follower 23 travelling in the curved section 31b of the third cam slot 31 causes the link member 22 to be lowered rotating the second regulator arm 20 about the pivot axis 21 in a counter-clockwise direction, while the first cam follower 12 travelling in the arcuate section 41b of the first cam slot 41 merely idles therein exerting no movement upon the first regulator arm 10. Thus, the main glass $W_2$ supported upon the second arm 20 is raised first while the vent glass $W_1$ remains at its lowermost position (FIG. 2).

When the second cam follower 23 enters the arcuate section 31*a* of the third cam slot 31 and the first cam follower 12 enters the straight inclined section 41*a* of the first cam slot 41 (FIG. 2), then the movement second cam follower 23 along section 31*a* causes the rotation of the link member 22 about the axis P in a counter-clockwise direction without causing any further corresponding movement of the second regulator arm 20 while the first cam follower 12 causes the rotation of the first regulator arm 10 about the axis 11 in a clockwise direction. Therefore, the vent glass $W_1$ supported on the first arm 10 is now raised.

In this first embodiment, the lowering and raising operations of the two glasses $W_1$ and $W_2$ are performed such that upon lowering, the vent glass $W_1$ is first lowered and after it has been fully lowered the main glass $W_2$ is then lowered while maintaining the vent glass $W_1$ to its lowermost position and that upon raising, the main glass $W_2$ is first raised and then the vent glass $W_1$ is raised while maintaining the main glass $W_2$ to its uppermost position.

DESCRIPTION OF THE SECOND EMBODIMENT: (FIGS. 6–8)

In this embodiment, only the second cam slot 142 provided in the sector gear 40 and the third cam slot 131 provided in the base plate 30 differ from the previous embodiment, and therefore, detailed description of the other elements is omitted.

The second cam slot 142 provided in the sector gear 40 comprises an arcuate section 142*a* concentric about the pivot axis 43 of the sector gear 40 and a first straight inclined section 142*b* merging with the arcuate section 142*a* and extending inwardly toward the pivot axis 43 of the sector gear 40. The third cam slot 131 on the base plate 30 consists only of a curved slot 131*b* extending from the free end of the link member 22 toward the pivot axis P.

Comparing such programming of the cam slots with those of the previous embodiment, the first straight inclined section 142*b* corresponds to the second cam slot 42 of the first embodiment and the arcuate section 142*a* corresponds to the arcuate section 31*a* of the third cam slot 31 of the first embodiment. This means that the arcuate section 31*a* of the first embodiment is substituted for the arcuate section 142*a* of the present embodiment.

Figure 6:
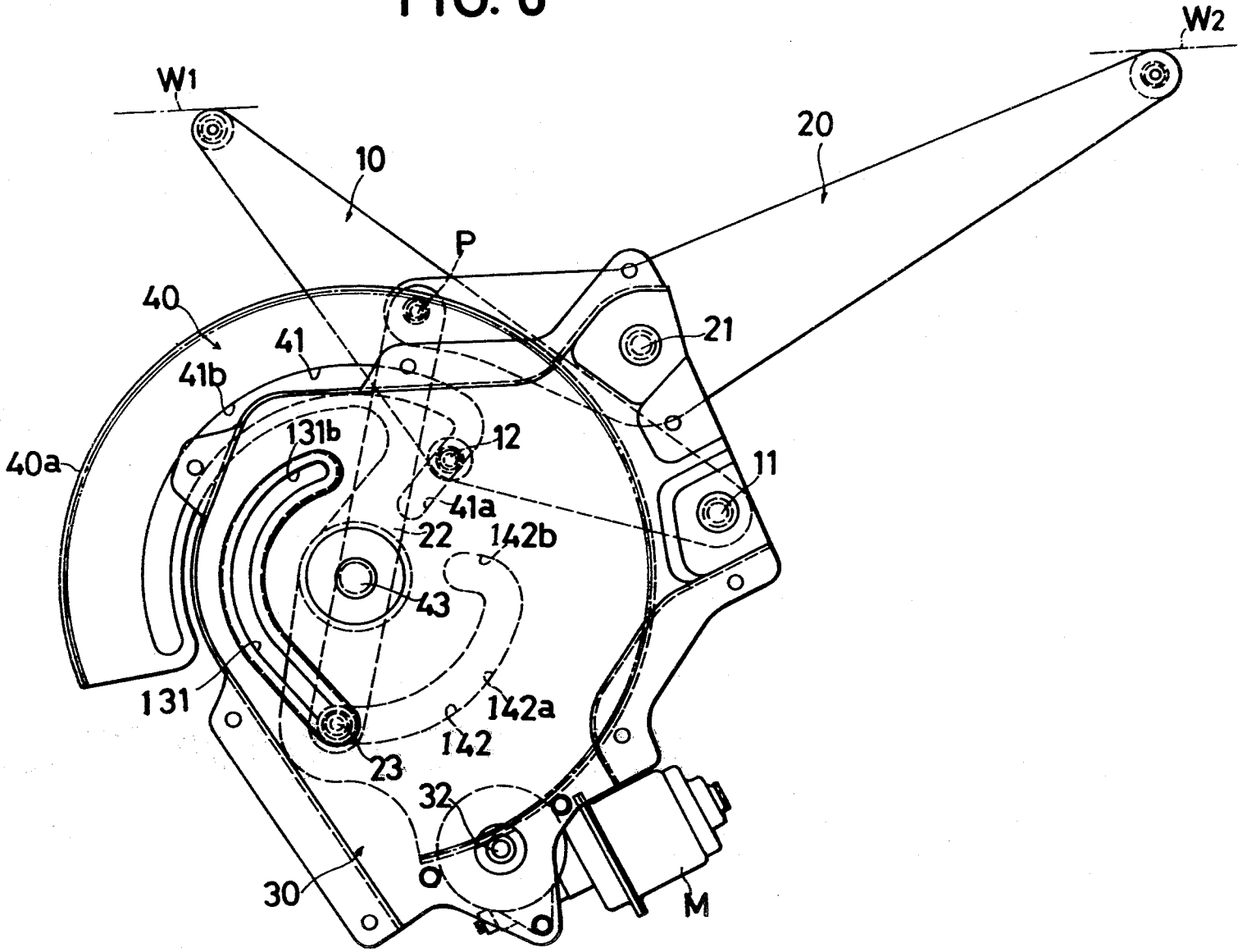
FIG. 6 is a perspective view of a vehicle window regulator mechanism of a second embodiment showing two glasses $W_1$ and $W_2$ being fully raised.
Figure 7:
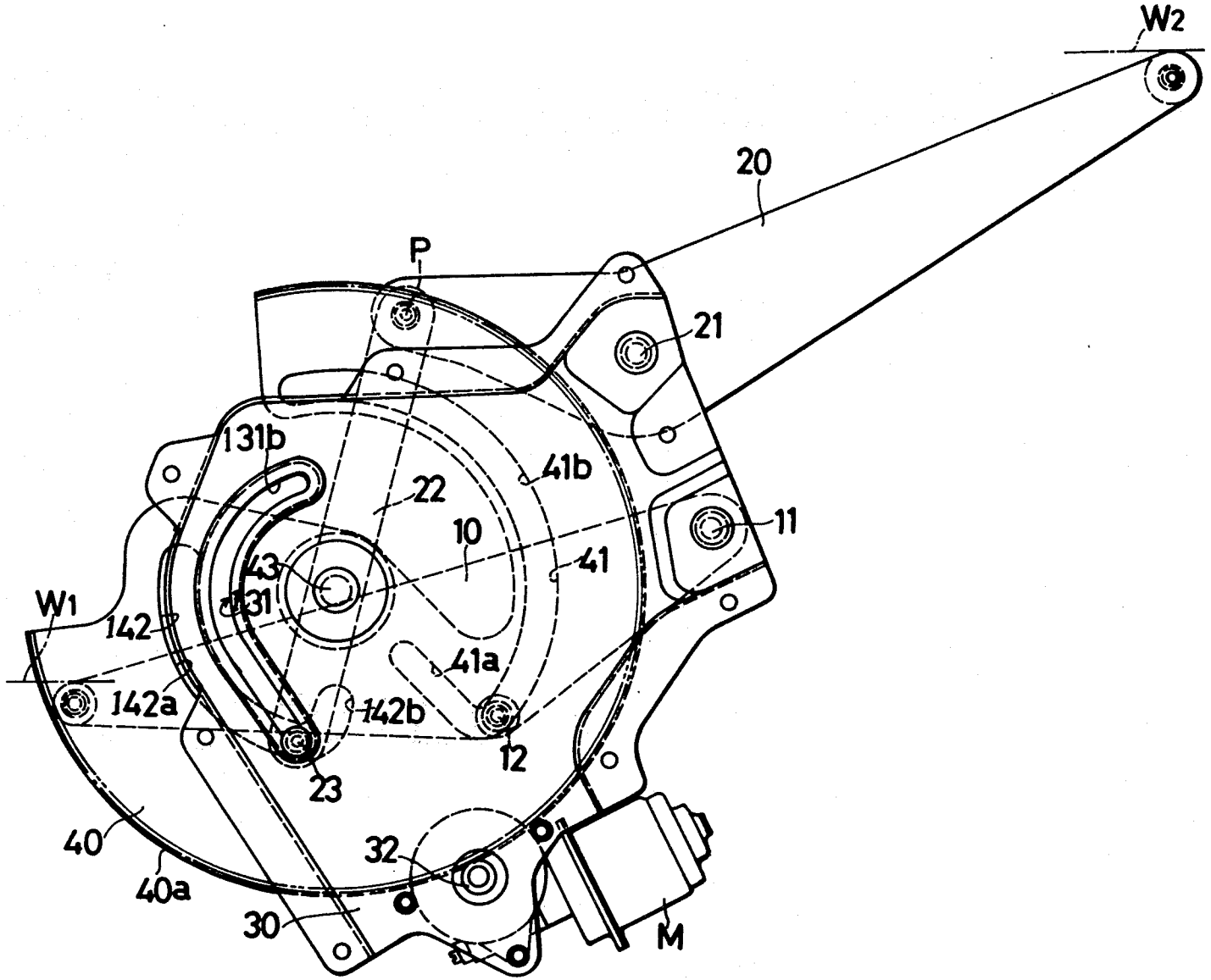
FIG. 7 is a view similar to FIG. 6 but showing a lowered position of the vent glass $W_1$.

The operation of this embodiment is as follows:

When the sector gear 40 starts to rotate in a clockwise direction as viewed in FIG. 6, the first cam follower 12 in the straight inclined section 41*a* of the first cam slot causes the rotation of the first regulator arm 10 about the axis 11 in a counter-clockwise direction to initiate the lowering of the vent glass $W_1$ which is the same as the previous embodiment, while the second cam follower 23 idles in the arcuate section 142*a* of the second cam slot 142, since the arcuate section 142*a* is concentric with axis 43. Thus, the lowering of the vent glass $W_1$ is performed while maintaining the main glass $W_2$ to its uppermost position (FIG. 7)

Figure 8:
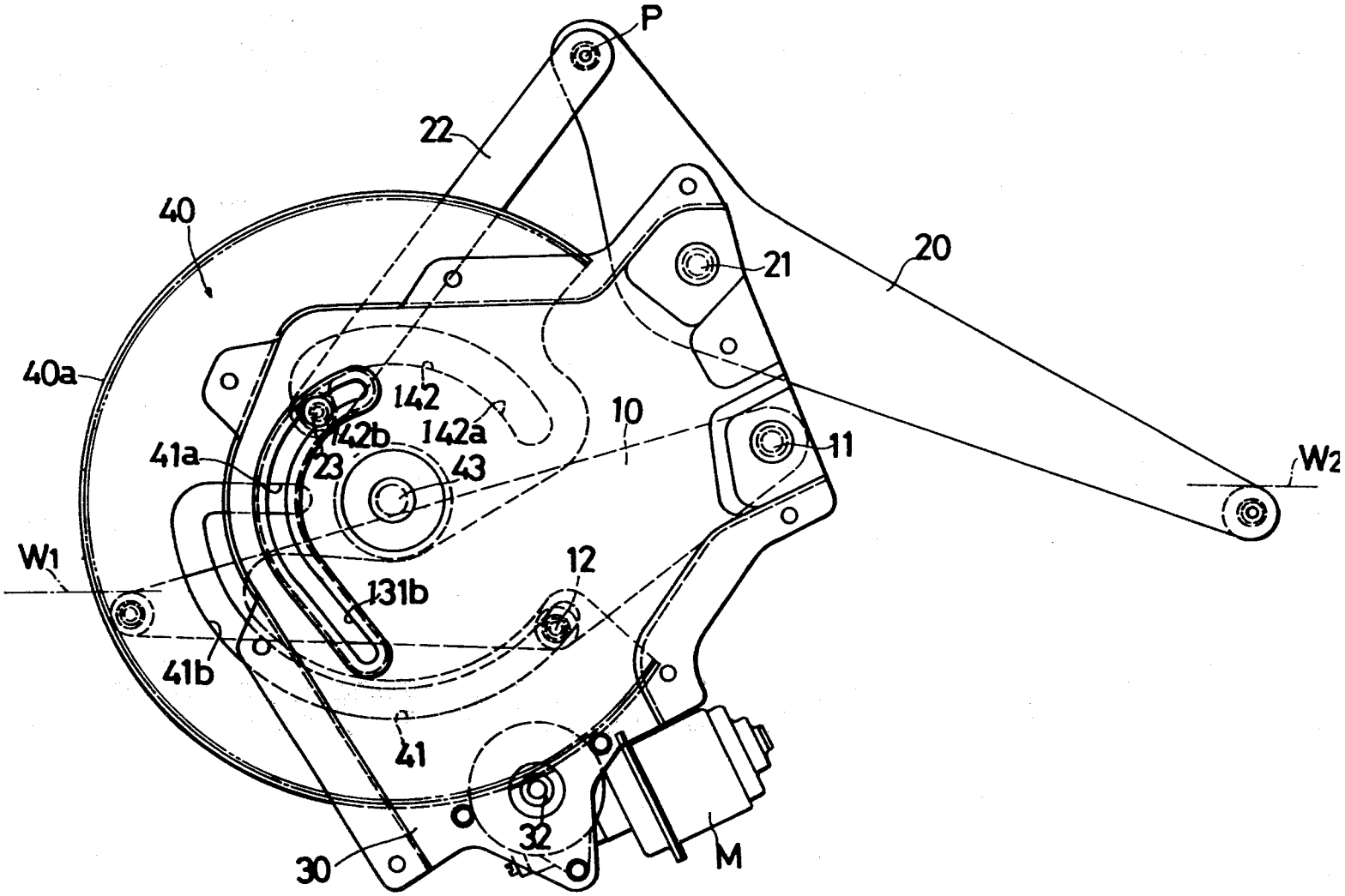
FIG. 8 is a view similar to FIG. 7 but showing both of the glasses $W_1$ and $W_2$ being lowered.

When the first and second cam followers reach the respective end portions of the sections 41*a* and 142*a* and the clockwise rotation of the sector gear 40 is further continued, the first cam follower 12 in the arcuate section 41*b* idles therein causing no further movement of the first regulator arm 10 while the second cam follower 23 in the first straight inclined section 142*b* is now forced to move along the curved section 131*b* of the third cam slot 131 thereby to push the link member 22 upwardly bo coaction between the walls of the sections 142*b* and 131*b* and the second cam follower 23. Therefore, in this stage the second regulator arm 20 is rotated about the axis 21 in a clockwise direction maintaining the first regulator arm 10 in its lowermost position (FIG. 8).

As is explained above, in this embodiment the vent glass $W_1$ is lowered first and after the vent glass $W_1$ has been fully lowered the main glass $W_2$ is then lowered while maintaining the vent glass $W_1$ in its lowermost position. The raising operation of thus lowered glasses $W_1$ and $W_2$ may be easily understood from the foregoing lowering operation, that is, upon a counterclockwise rotation of the sector gear 40 about the pivot axis 43 from the position shown in FIG. 8, the second cam follower 23 is moved downwardly along the curved section 131*b* to rotate the second arm 20 in a counter-clockwise direction to raise the main glass $W_2$ supported thereupon, while the first cam follower 12 idles in the arcuate section 141*b* of the first cam slot 41 causing no movement of the first regulator arm 10.

When the first and second cam followers 12, 23 reach the respective sections 41*a* and 142*a* of the first and second cam slots 41, 142 upon further counter-clockwise rotation of the sector gear 40, the first cam follower 12 in the straight inclined section 41*a* will cause the first arm 10 to rotate in a counter-clockwise direction about the pivot axis 11 to raise the vent glass $W_1$ supported thereupon while the second cam follower 23 idles in the arcuate section 142*a* of the second cam slot 42 without causing any further rotation of the second regulator arm 20.

DESCRIPTION OF THE THIRD EMBODIMENT: (FIG. 9–13A)

In this embodiment, the second cam slot 242 provided in the sector gear 40 comprises a second straight inclined section 42c continuous with the arcuate section 242*a* which is similar arcuate section 142*a* of the second embodiment. The second straight inclined section 242*c* is extended toward the pivot axis 43 of the gear section 40 at the opposite end of arcuate section 242*c* from the straight inclined section 242*b*. The other elements are completely the same as those of the second embodiment, and therefore, detailed description thereof is omitted.

Figures 9, 9A:
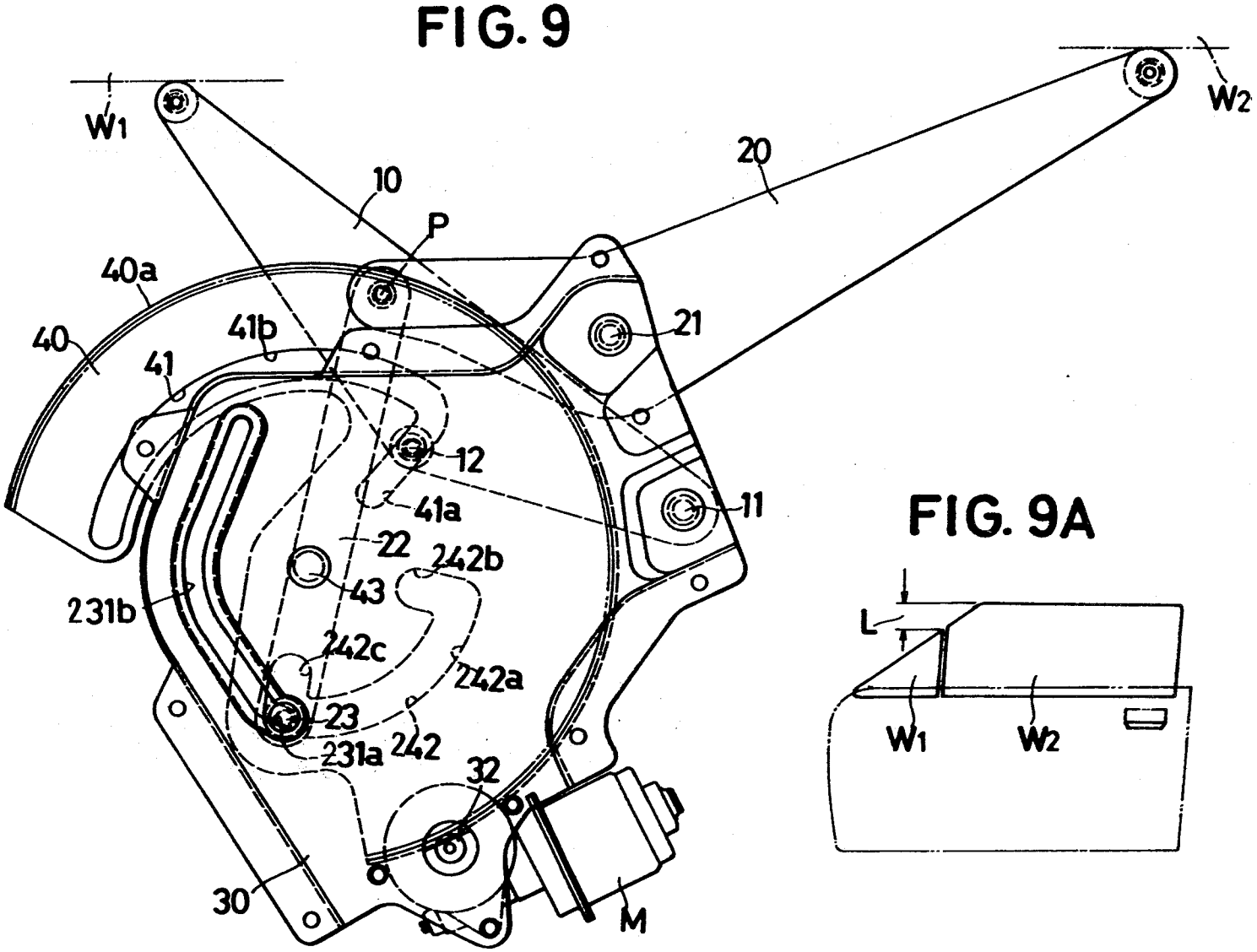
FIG. 9 is a perspective view of a vehicle window regulator mechanism of a third embodiment of this invention showing two glasses $W_1$ and $W_2$ being fully raised.
FIG. 9A shows the fully raised positions of the two glasses $W_1$ and $W_2$ corresponding to the regulator position in FIG. 9.

The operation of this embodiment is as follows:

The position shown in FIG. 9 and FIG. 9A illustrates both of the glasses $W_1$ and $W_2$ as being fully raised.

Figures 10, 10A:
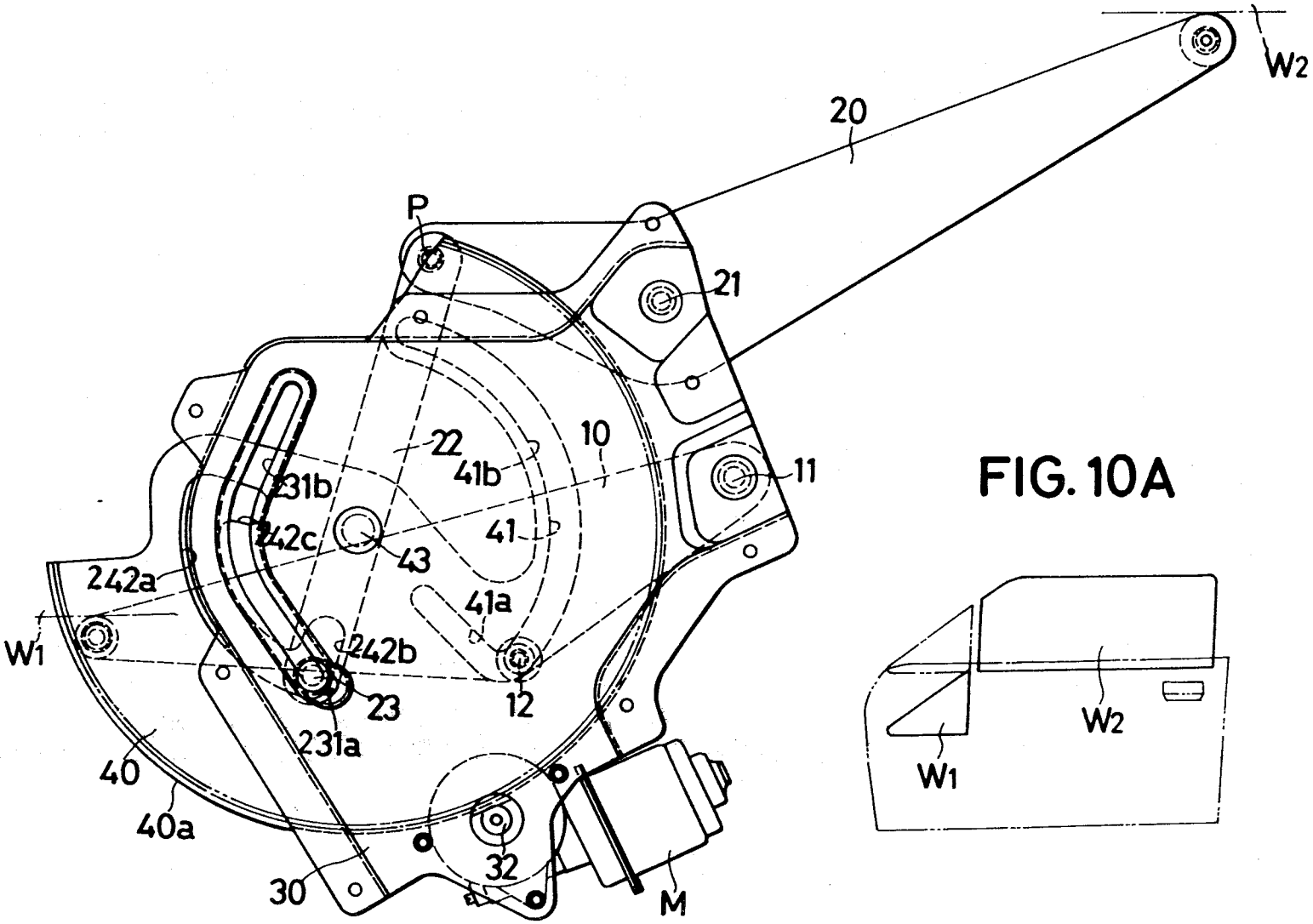
FIG. 10 is a view similar to FIG. 9 but showing a lowered position of the vent glass $W_1$.
FIG. 10A shows the positions of the two glasses $W_1$ and $W_2$ in full lines corresponding to the regulator position in FIG. 10.

From this position, the window glasses $W_1$ and $W_2$ may be lowered by actuating the motor M to rotate the pinion gear 32 in a counter-clockwise direction as in the previous embodiments. The counter-clockwise rotation of the pinion gear 32 drives the sector gear 40 in a clockwise direction about the pivot axis 43. The first cam follower 12 in the straight inclined section 41a of the first cam slot 41 causes the rotation of the first regulator arm 10 in a counter-clockwise direction about the axis 11 thereby lowering the vent glass $W_1$ supported on the arm 10, while the second cam follower 23 in the arcuate section 242*a* of the second cam sbt242 moves therein without causing any movement of the second regulator arm 20. Upon further clockwise rotation of the sector gear 40, the first cam follower 12 is moved into the arcuate section 41*b* of the first cam slot 41 and the second cam follower 23 is moved into the first straight inclined section 242*b* of the second cam slot 242 as is viewed in FIG. 10. Under such conditions, the first cam follower 12 is moved in the arcuate section 41*b* without causing any further movement of the first regulator arm 10 while the second cam follower 23 is moved in the curved section 31*b* of the third cam slot 31 by being pushed by the inside wall of the first straight inclined section 242*b* of the second cam slot 242.

Due to the movement of the second cam follower 23 into the curved section 31*b* of the third cam slot 31, the second regulator arm 20 is rotated about the axis 21 in a clockwise direction through the link member 22 connected thereto thereby lowering the main glass $W_2$ supported on the second arm 20.

Thus, the vent glass $W_1$ is first lowered and after the lowering operation thereof is completed the main glass $W_2$ is lowered. (FIG. 11, FIG. 11A).

Figure 11A:
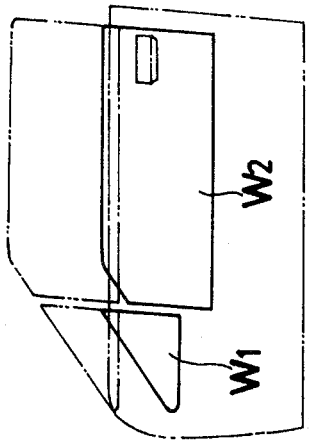
FIG. 11A shows the positions of two glasses $W_1$ and $W_2$ in full lines cooresponding to the regulator position of FIG. 11.
Figure 11:
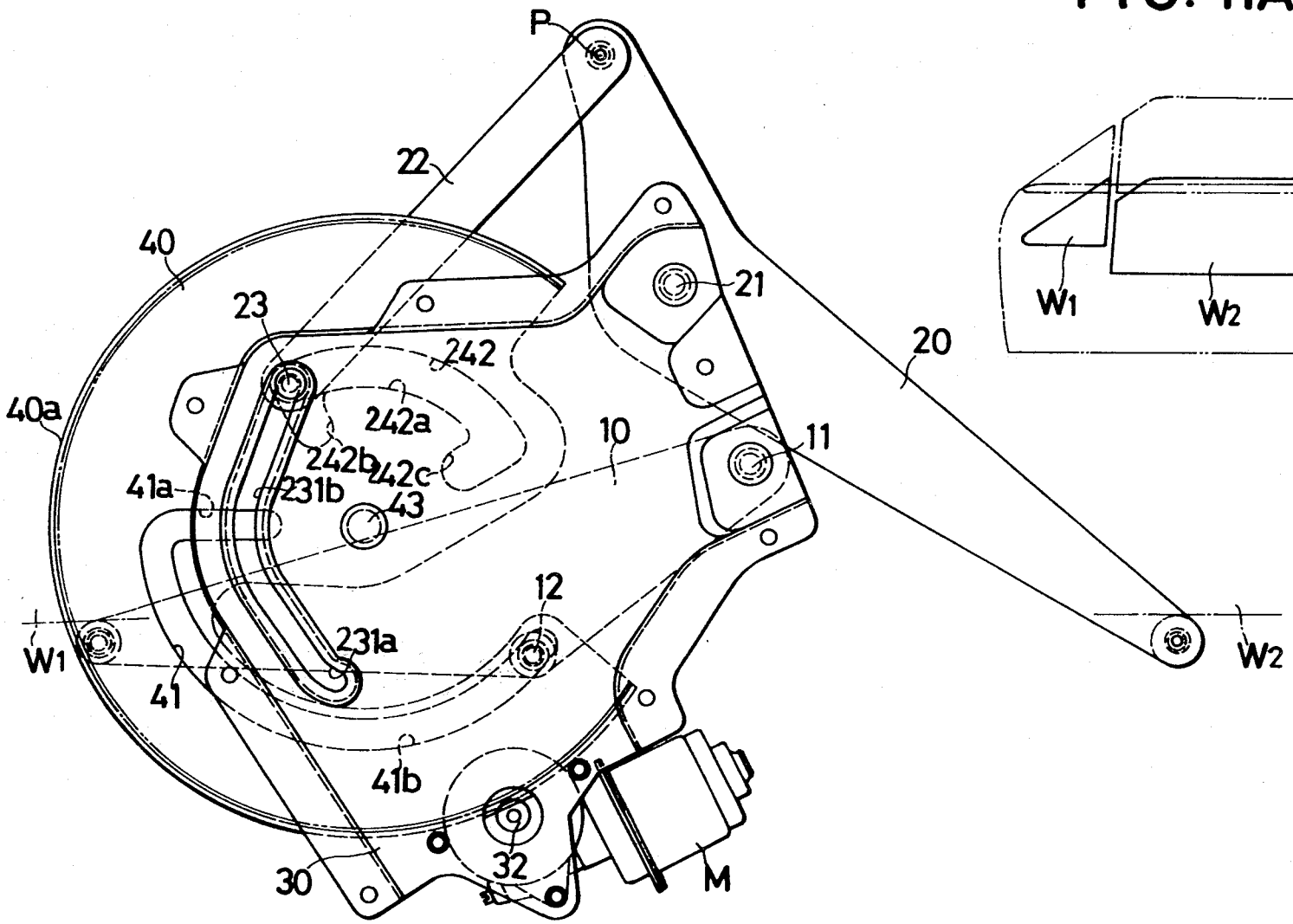
FIG. 11 is a view similar to FIG. 9 but showing both of the glasses $W_1$ and $W_2$ being fully lowered.

To raise the glasses $W_1$ and $W_2$ from the position in FIGS. 11 and 11A, the motor M is actuated to rotate the pinion gear 32 in a clockwise direction as viewed in FIG. 11. This clockwise rotation of the pinion gear 32 causes to rotate the sector gear 40 in a counter-clockwise direction. The first cam follower 12 travelling in the arcuate section 41*b* of the first cam slot 41 merely idles therein exerting no movement upon the first regulator arm 10, while the second cam follower 23 travelling in the arcuate section 242*a* of the second cam slot 242 also idles therein exerting no movement upon the second regulator arm 20 until the follower 23 moves into the second straight inclined section 242*c*. The second cam follower 23 which is positioned in the second straight inclined section 242*c* will move in the curved section 31*b* causing the link member 22 to move downwardly, thereby, rotating the second regulator arm 20 in a counter-clockwise direction about the axis 21 to raise the main glass $W_2$ upwardly, while the first cam follower 12 still travels in the arcuate section 41*b* causing without any movement of the first regulator arm 10.

Figures 13, 13A:
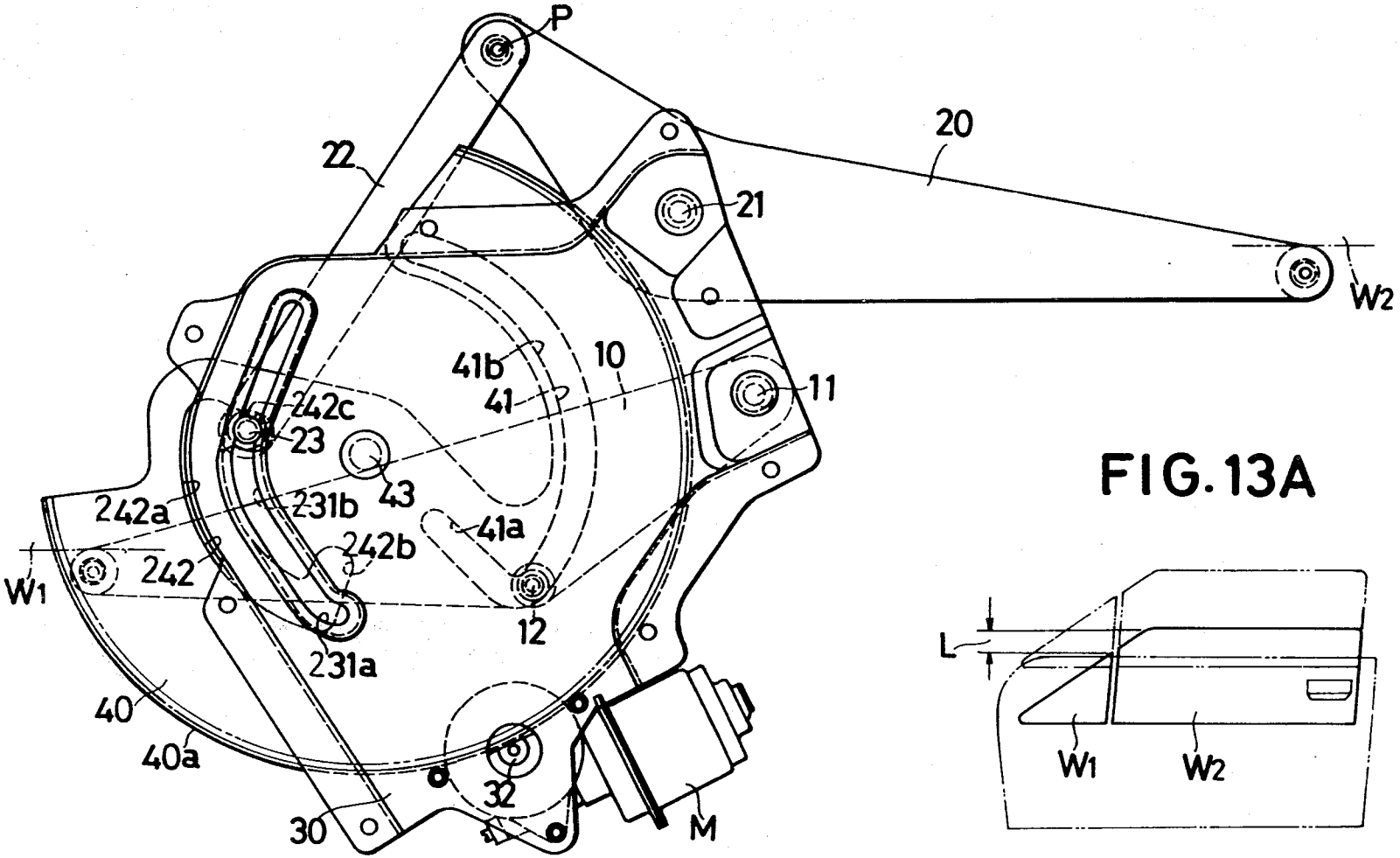
FIG. 13 is a view similar to FIG. 9 but showing the main glass $W_2$ being in a half raised position while the vent glass $W_1$ is still in a fully lowered position.
FIG. 13A shows the positions of two glasses in full lines corresponding to the regulator position of FIG. 13.

After the second regulator arm 20 has been rotated to the position shown in FIG. 13 i.e., the main glass $W_2$ is raised about a distance L indicated in FIG. 13A, then the first cam follower 12 reaches the straight inclined section 41a to rotate the first regulator arm 10 in a clockwise direction about the axis 11 to raise the vent glass $W_1$ upwardly.

Thus, in this embodiment, when the glasses $W_1$ and $W_2$ which have been lowered are to be raised, the main glass $W_2$ is first raised to the amount of L, then the vent glass $W_1$ is raised simultaneously with the main glass $W_2$ so that the two glasses $W_1$ and $W_2$ reach the fully raised position as the same time.

DESCRIPTION OF THE FOURTH EMBODIMENT (FIGS. 14–19)

In this embodiment, there is provided a projection 40*b* at one end of the toothed portion 40*a* of the sector gear 40 in order to actuate the rotational movement of the sector gear 40 by an electric means (this will be explained according to FIG. 19). A normally open switch means 50 is provided at the base plate 30 which is to be actuated by the projection 406 when the two regulator arms 10, 20 are fully lowered. (See FIG. 16)

Figure 19:
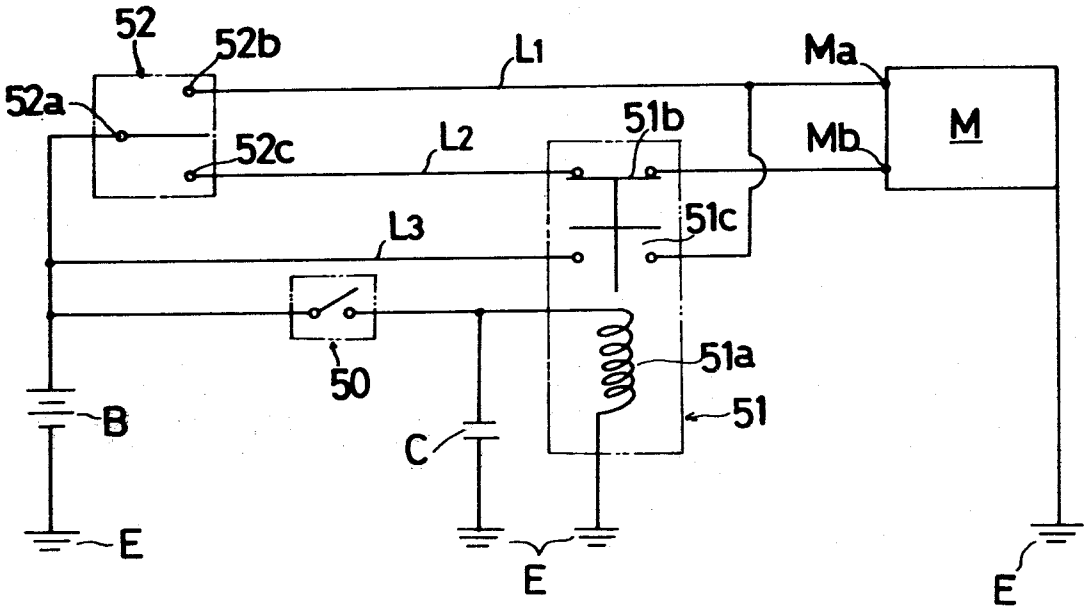
FIG. 19 shows an electric circuit incorporated into the fourth embodiment.
Figure 20:
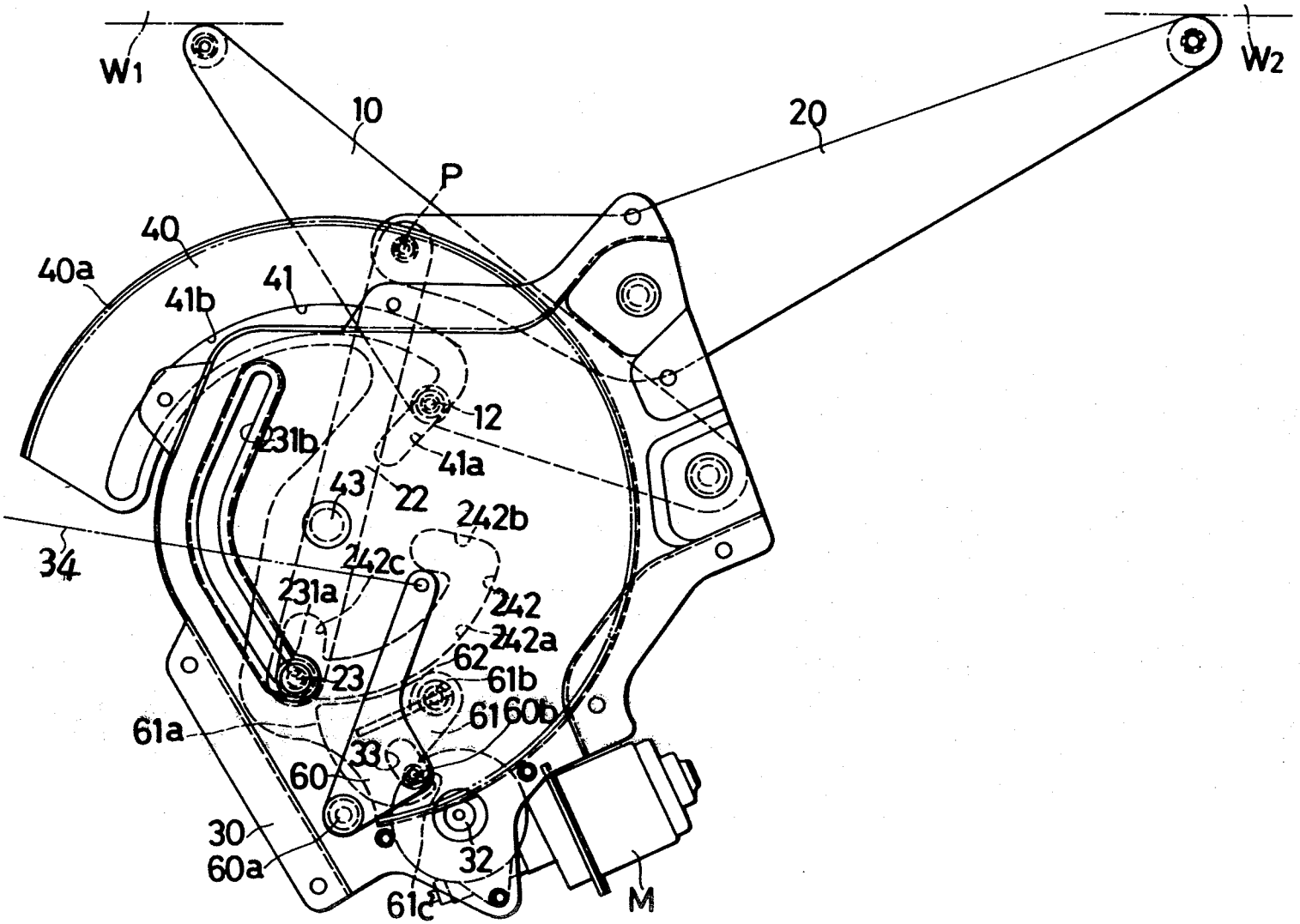
FIG. 20 is a perspective view of a vehicle window regulator mechanism of a fifth embodiment of the invention showing two glasses being fully raised.

The electric circuit of the aforementioned electric means will be now explained in accordance with FIG. 19.

The switch 50 is connected to a power source B as well as to a relay coil 51*a* of a relay switch assembly 51. Between the switch 50 and the relay coil 51*a* is provided a condensor C parallel to the latter. The relay switch assembly 51 further includes a normally closed contact 51*b* and a normally open contact 51*c*. A motor actuating change over switch assembly 52 includes an input terminal 52*a* connected to the power source B and a pair of first and second output terminals 52*b* and 52*c* the first of which is connected to a terminal Ma of the motor M through a lead L. and the second of which is connected to a termail M*b* of the motor M through a lead $L_2$. The normally closed contact 51*b* of the relay switch assembly 51 is connected to the lead $L_2$ between the termials 52*c* and M*b*, while the normally open contact 51*c* of the relay switch assembly 51 is connected to a lead $L_3$ which is branched from the lead $L_1$ between the terminals 52*b* and M*a* and which is further connected to the power source B.

Figure 14:
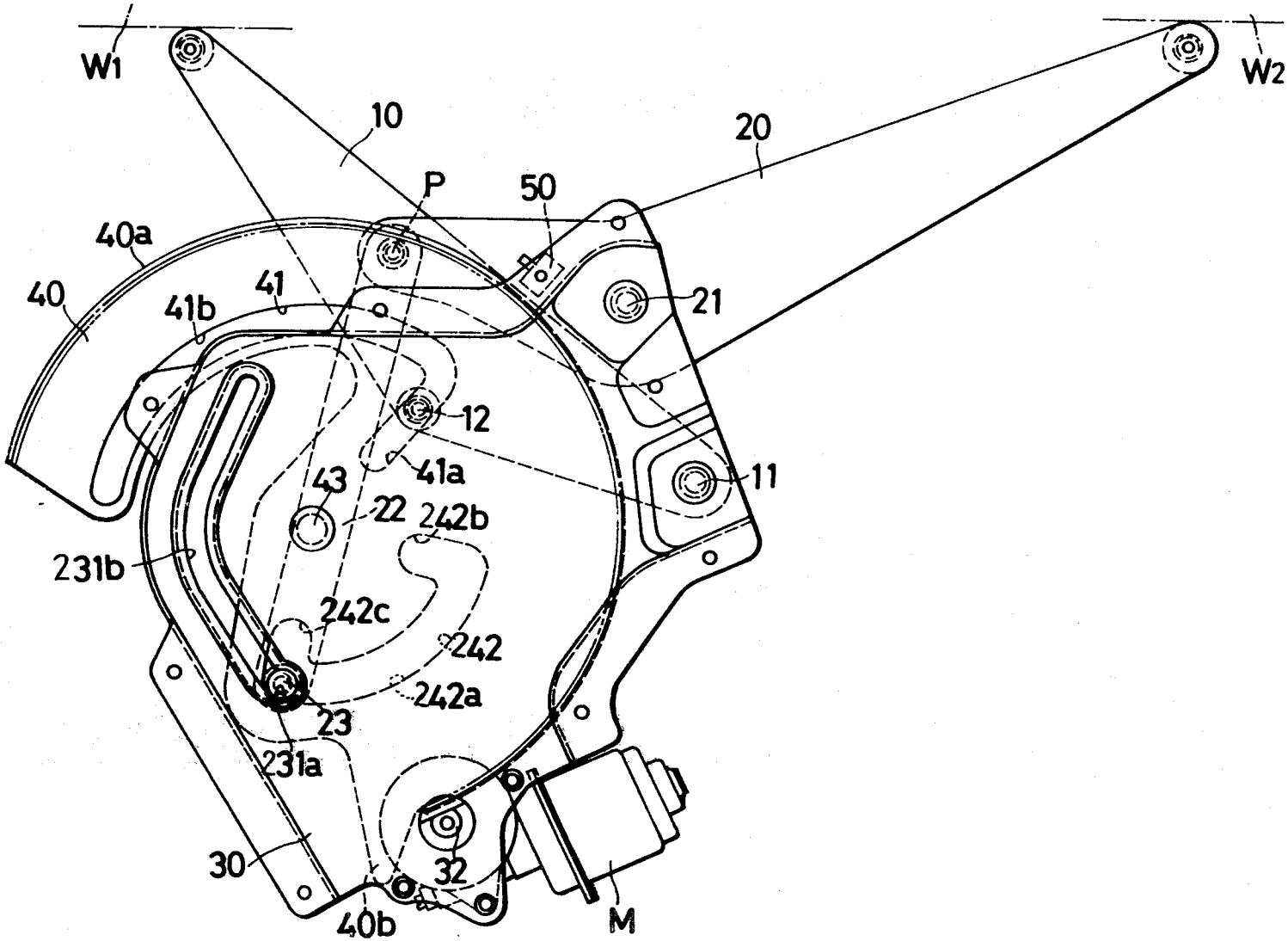
FIG. 14 is a perspective view of a vehicle window regulator mechanism of a fourth embodiment of this invention showing two glasses being fully raised.
Figure 15:
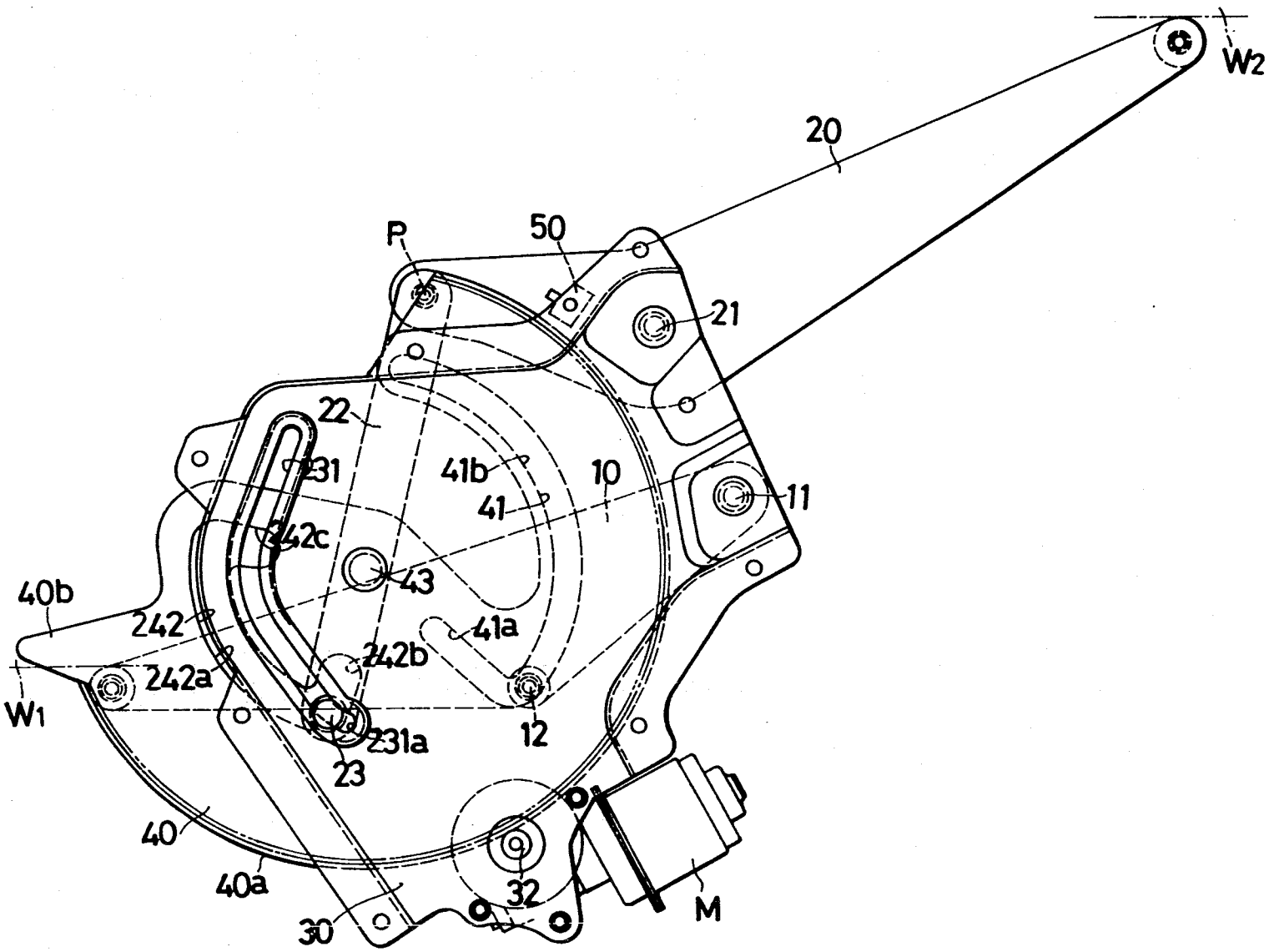
FIG. 15 is a view similar to FIG. 14 but showing a lowered position of the vent glass $W_1$.

The change over switch 52 is normally positioned in a neutral position as shown in FIG. 19, and when it is operated to connect the input terminal 52*a* with the first output terminal 52*b* the motor M will rotate the sector gear 40 in a counter-clockwise direction (as viewed in FIG. 16) and when the switch 52 is operated to connect the input terminal 52 a with the second output terminal 52*c* the motor M will rotate the sector gear 40 in a clockwise direction. Therefore, to lower the glasses $W_1$ and $W_2$ from the position in FIG. 14, the change over switch 52 is operated to connect the input terminal 52*a* with the second output terminal 52*c* to actuate the motor M thereby performing the lowering operation of the glasses $W_1$ and $W_2$ which is precisely the same as the previous embodiment. However, when the sector gear 40 is rotated to the position shown in FIG. 16, the projection 40*b* will contact to close the normally open switch 50 and thus the condensor C is charged and the relay coil 51*a* is actuated to open the normally closed contact 51*b* and to close the normally open contact 51*c*.

Figure 16:
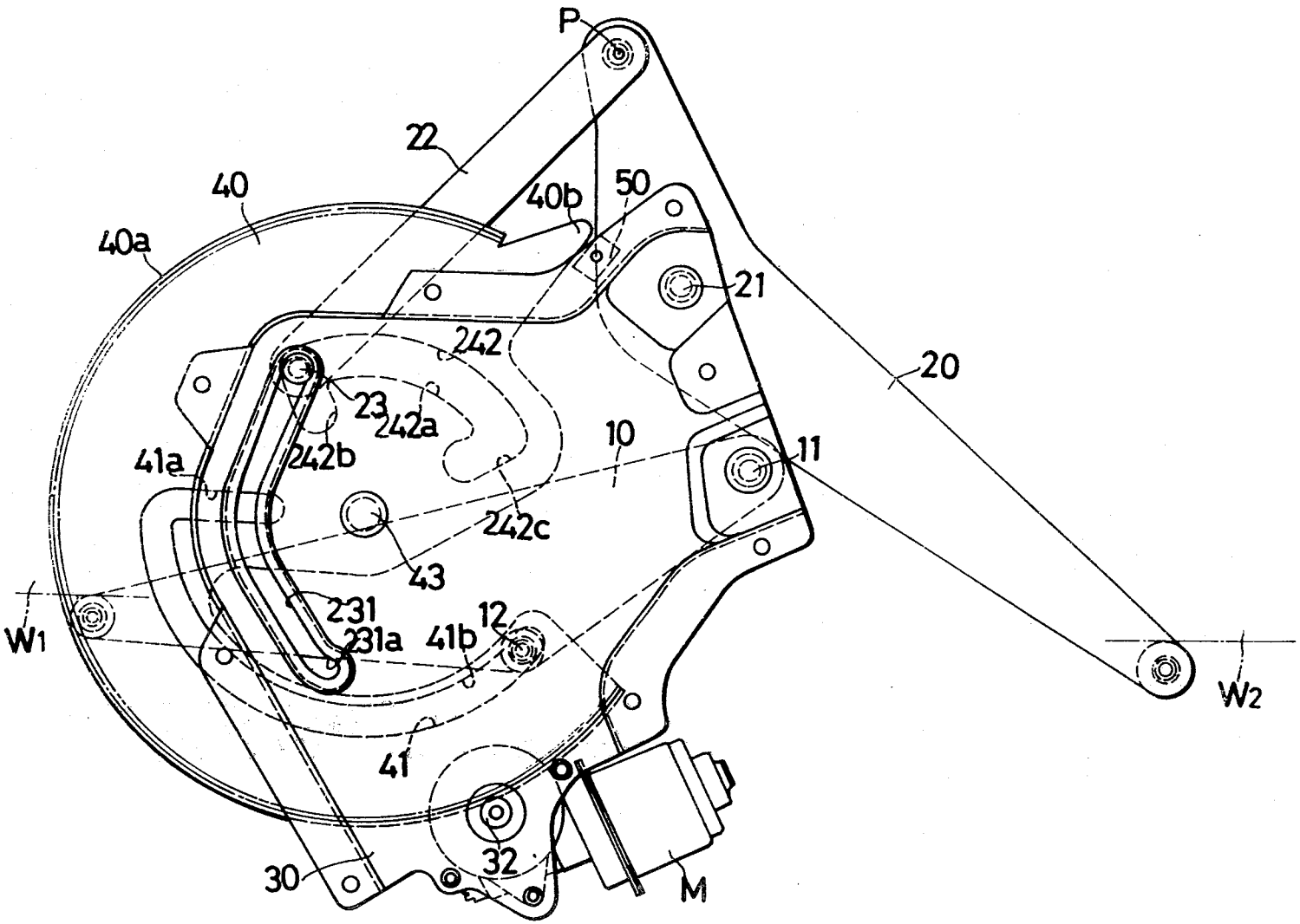
FIG. 16 is a view similar to FIG. 15 but showing both of the glasses $W_1$ and $W_2$ being fully lowered.
Figure 17:
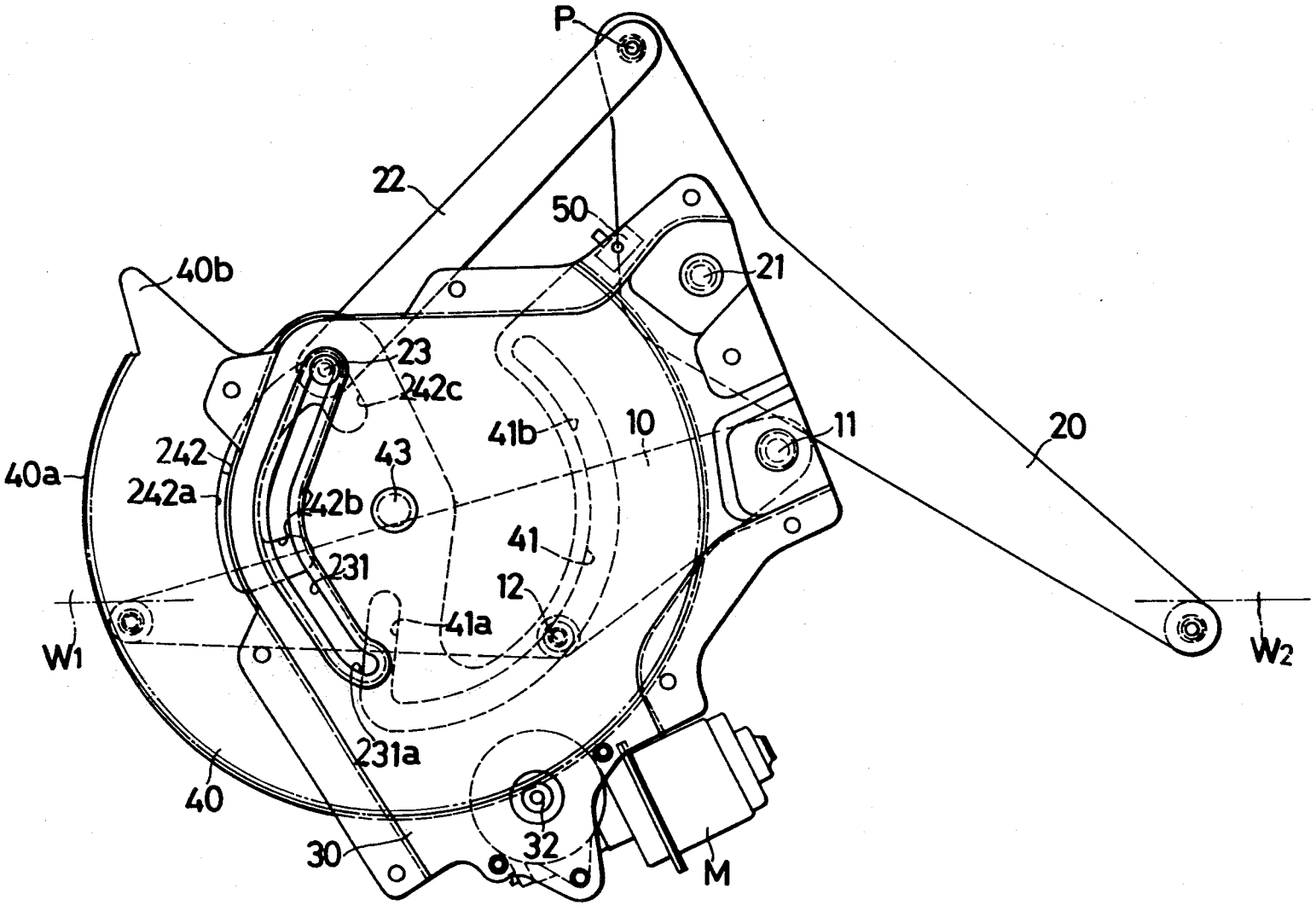
FIG. 17 is a view similar to FIG. 16 but showing the switch means 50 being actuated.
Figure 18:
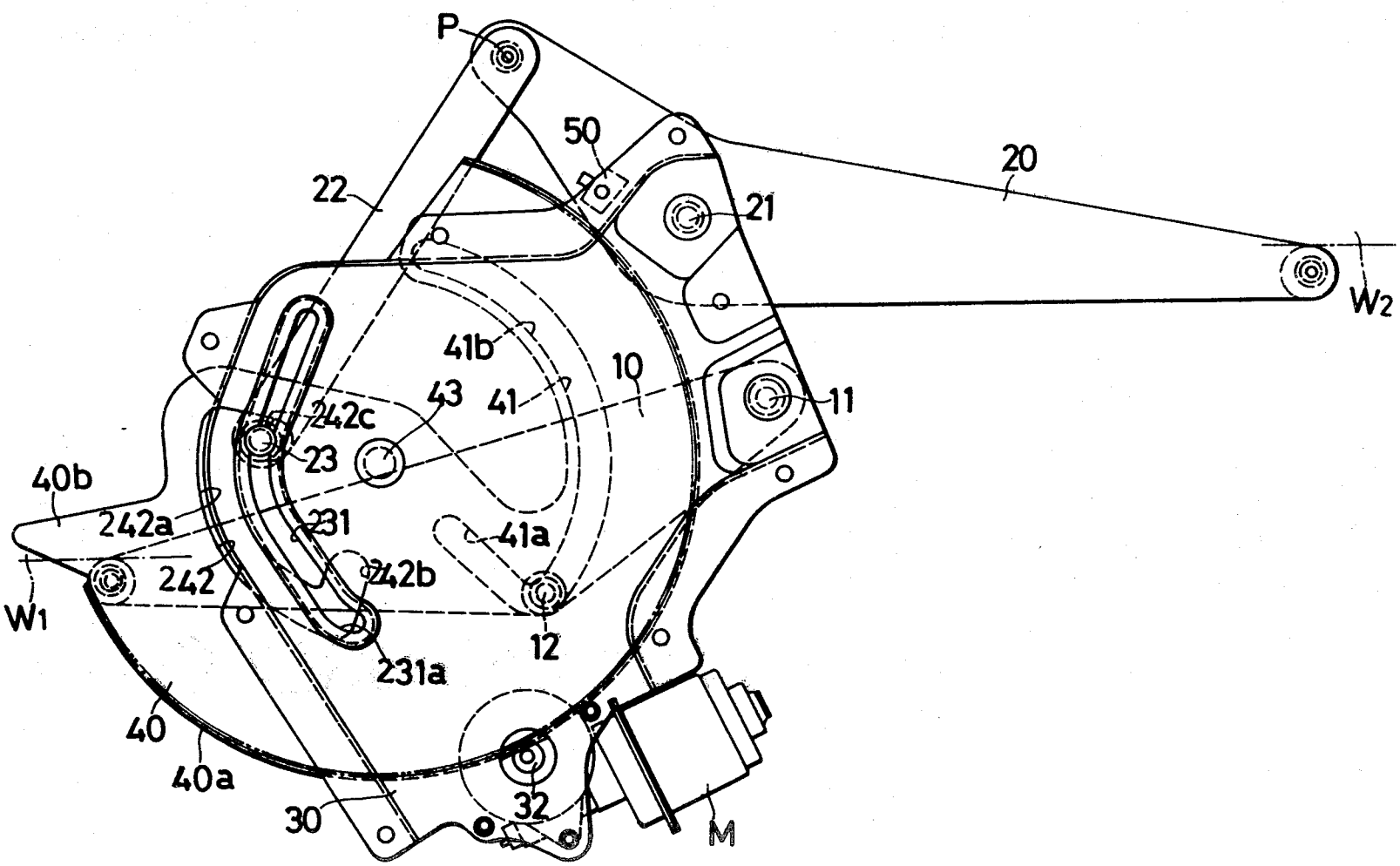
FIG. 18 is a view similar to FIG. 16 but showing the main glass $W_2$ being half raised while the vent glass $W_1$ being still lowered.

Under such conditions, the communication between the terminals 52*c* and M*b* is interrupted and the communication between the terminals 52*b* and M*a* completed thereby rotating the sector gear 40 in a reverse direction (in a counter-clockwise direction) from the position of FIG. 16 to that of FIG. 17.

Figure 12A:
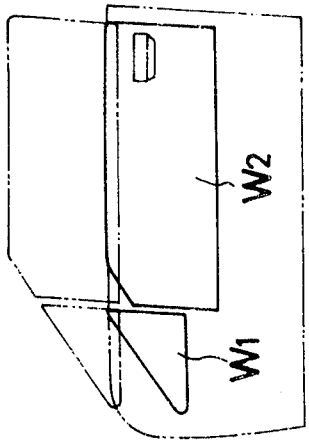
FIG. 12A shows the positions of two glasses $W_1$ and $W_2$ in full lines corresponding to the regulator position of FIG. 12 (the positions of $W_1$ and $W_2$ in this Figure are precisely the same as those of FIG. 11A)
Figure 12:
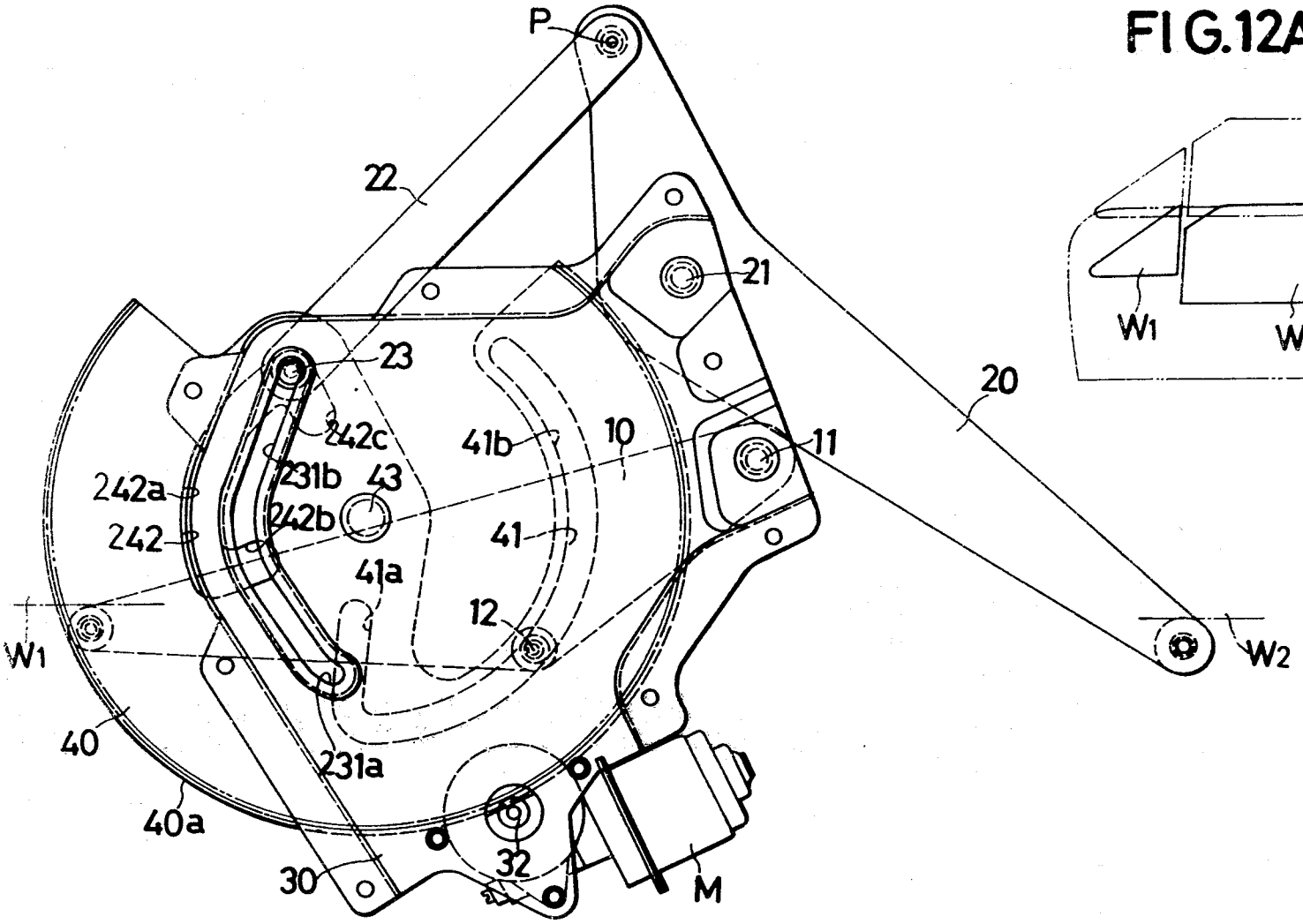
FIG. 12 is a view similar to FIG. 11 but showing a lost motion of the second regulator arm 20 (difference between FIG. 11

Even though switch 50 opens as soon as reverse rotation begins, this reverse rotation continues for a predetermined time due to discharge of the condensor C. Before such predetermined time lapses, the switch 52 would be returned to the neutral position between contacts 52*b* and 52*c* so that the motor M will stop when relay 51 releases. The second cam follower 23 will have reached to the second straight inclined section 252*c* of the second cam slot 242 so that the operation of the raising of the glasses $W_1$ and $W_2$ initiated immediately upon operation of switch 52 to close switch 52*b*. Thus, the lost motion of the previous embodiment (esp. in FIG. 12) is effectively eliminated in this embodiment, and therefore, the raising operation can be promptly initiated.

DESCRIPTION OF THE FIFTH EMBODIMENT

In this embodiment, there is provided a manual operating means in addition to the automatic operating means (e.g. motor M etc.) The manual operating means includes a change lever 60 pivotally mounted alone end on the base plate 30 through a pivot pin 60*a* and a blocking cam lever 61 pivotally mounted on the sector gear 40 through a pivot pin 61*b*. The change lever 60 is at its central portion provided with a roller 60*b* which is rotatably moveable within a slot 33 provided in the base plate 30 and is at its the other end connected with a link member 34.

Thus, the change lever 60 is rotated about the axis 60*a* by the operatin of the link member 34 but such rotation is controlled by the slot 33 and the roller 60*b*. The blocking cam lever 61 includes a sector shaped cam face 61*a* and a hook portion 61*c* which is engageable with the roller 60*b* of the change lever 60. The pivot axis 61*b* of the blocking cam lever 61 is positioned outwardly from the second cam slot 252 and the blocking cam lever 61 is normally biased to a position juxtaposed to the outside wall of the second cam slot 242 by a return spring 62. The blocking cam lever 61 is rotatable about the axis 61*b* by engagement between the hook portion 61*c* and the roller 60*b* upon rotational movement of the change lever 60. Upon a clockwise rotation of the blocking cam lever 61 about the axis 61*b* the second cam follower 23 is prevented from movement into the arcuate section 252*a* of the second cam slot due to the engagement between the second cam follower 23 and the cam face 61*a* of the blocking cam lever 61. Therefore, the cam follower 23 will under such condition be moved into the second straight inclined section 242*c*.

In operation, when the manual operating means is not used, the operation of lowering and raising the glasses $W_1$ and $W_2$ is the same to the third embodiment and description thereof may be omitted herefrom.

Figure 21:
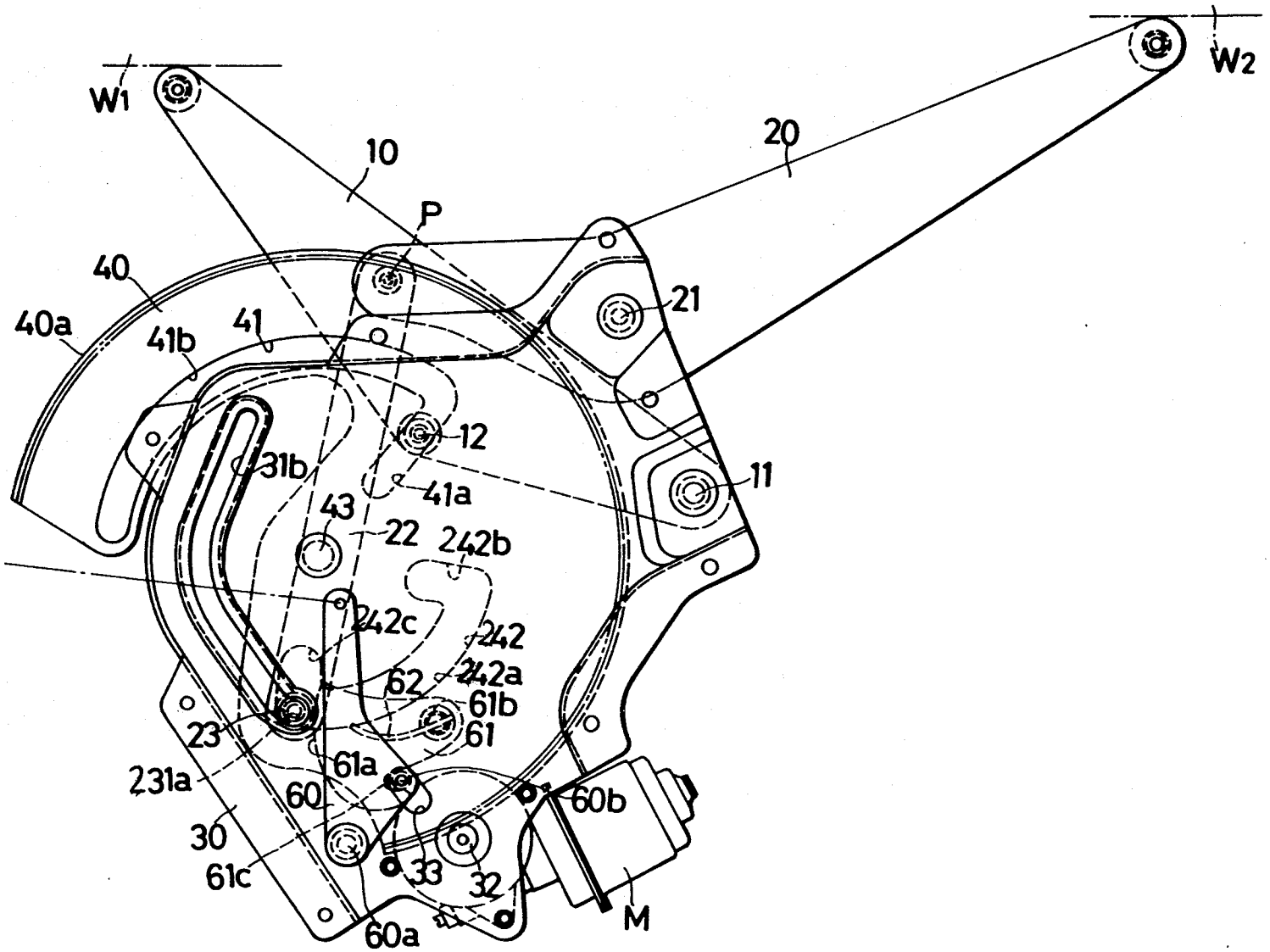
FIG. 21 is a view similar to FIG. 20 but showing the stopper means being operated.
Figure 22:
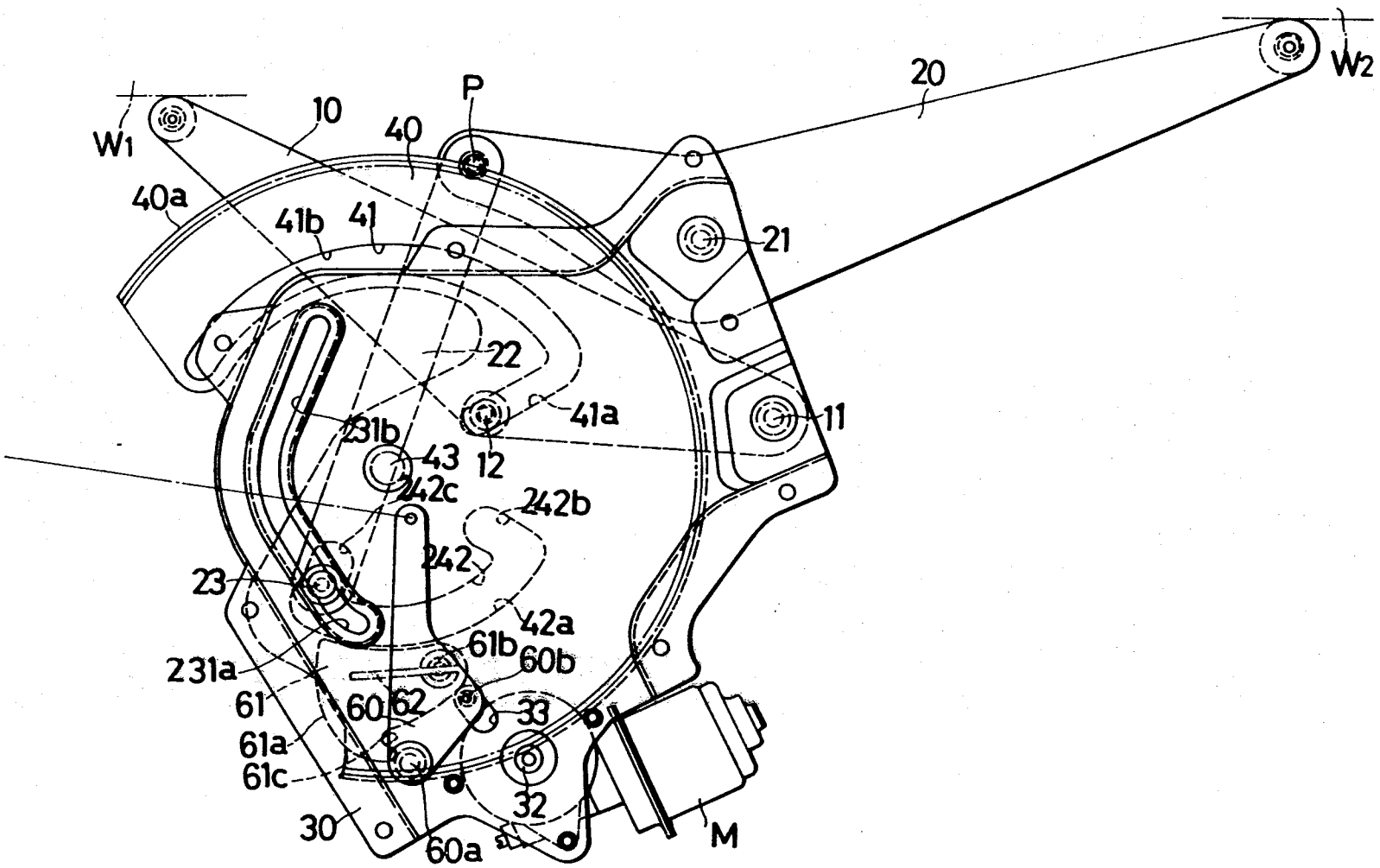
FIG. 22 is a view similar to FIG. 21 but showing the two glasses $W_1$ and $W_2$ in the first stages of being lowered.

In order to lower the glasses $W_1$ and $W_2$ at the same time and in a short time, the operator at first rotates the change lever 60 to the position shown in FIG. 21 through the link member 34. The blocking cam lever 61 then rotates in a clockwise direction about the axis 61*b* by engagement between the hook portion 61*c* and the roller 60*b* and overrides the arcuate section 242 to block the second cam follower 23 from travelling into the arcuate section 242*a* by engaging with the cam face 61*a*.

In this condition, when the motor M is actuated to rotate the sector gear 40 in a clockwise direction, since the second cam follower 23 has been moved into the second straight inclined section 242*c* of the second cam slot 242 due to the cam face 61*a* of the blocking cam lever 61, the second cam follower 23 moves in the third cam slot 31 to rotate the second regulator arm 20 in a clockwise direction through the link member 22 to lower the main glass $W_2$ supported upon the second arm 20, while the first cam follower 12 travelling in the straight inclined section 41*a* of the first cam slot 41 causes the rotation of the first regulator arm 10 in a counterclockwise direction to lower the vent glass $W_1$ supported thereupon.

Figure 23:
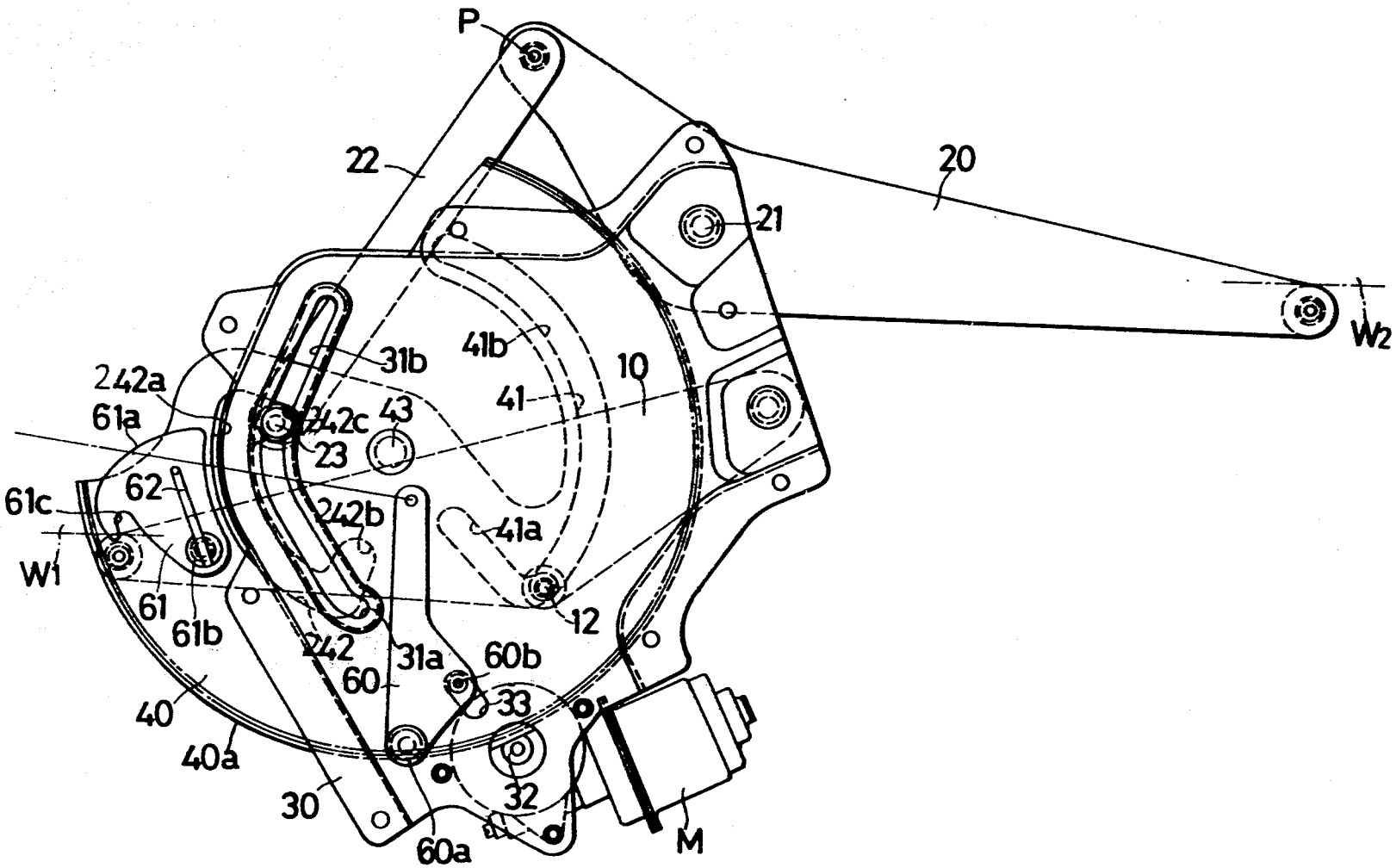
FIG. 23 is a view similar to FIG. 22 but showing the two glasses $W_1$ and $W_2$ in a further lowered position.
Figure 24:
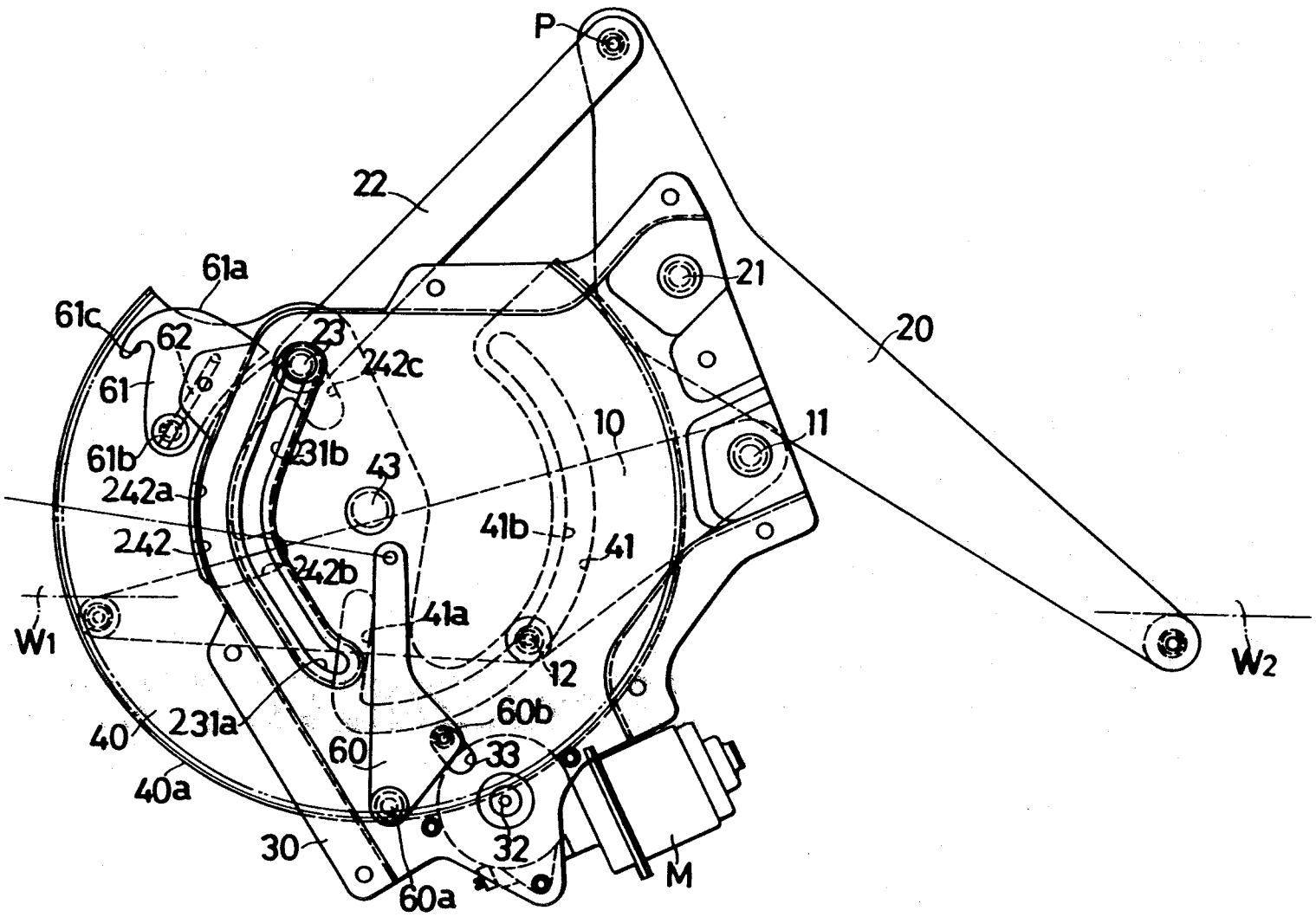
FIG. 24 is a view similar to FIG. 23 but showing the two glasses $W_1$ and $W_2$ as being fully lowered.

When the first cam follower 12 reaches the arcuate section 41*b* the rotational movement of the first regulator arm 10 stops, however, the second regulator arm 20 still continues to rotate in the clockwise direction, lowering the main glass $W_2$ downwardly (FIGS. 23 and 24).

Thus, in this embodiment, the main glass $W_2$ and vent glass $W_1$ are initially lowered at the same time, and therefore, in case the driver of the vehicle wishes to lower or open the main glass $W_2$ promptly, the two glasses $W_1$ and $W_2$ are lowered at the same without waiting the vent glass $W_1$ to be lowered prior to the main glass $W_2$.

In addition, if the electric switch means (40*b*, 50, 52) of the previous embodiment (FIGS. 14–19) is incorporated into this embodiment, then two glasses $W_1$ and $W_2$ may be raised as well as be lowered at the same time without waiting the main glass $W_2$ to be raised prior to the vent glass $W_1$.

Thus, in this invention, the two window glasses may be lowered and raised independently of each other by combining any of the above described embodiments.

What is claimed is:

1. A vehicle window regulator mechanism comprising:
   - a base plate secured to a vehicle door;
   - a sector gear pivotally mounted upon said base plate;
   - a drive pinion gear for rotating said sector gear about the pivot axis thereof;
   - a first regulator arm pivotally mounted upon said base plate and supporting a first window glass section;
   - a second regulator arm pivotally mounted upon said base plate and supporting a second window glass section;
   - a plurality of cam slots provided in said base plate and said sector gear comprising a first cam slot provided in said sector gear and having a straight inclined section radially directed toward the pivot axis of said sector gear and an arcuate section continuous with said straight inclined section and being concentric to the pivot axis of said sector gear, a second cam slot provided in said sector gear and a third cam slot provided in said base plate;
   - first and second cam followers, a link member having one end pivotally mounted on one end of said second regulator arm;

said first cam follower secured to said first regulator arm intermediate the ends of the first regulator arm and movably disposed in said first cam slot;

said second cam follower secured to the other end of said link member and movably disposed in said second and third cam sots, said second cam slot having an arcuate section concentric with the pivot axis of said sector gear and said third cam slot having a curved section circumferentially provided in said base plate and extending toward the pivot axis of said link member whereby upon rotation of said sector gear said first cam follower rotates said first regulator arm by travelling in said first cam slot to raise or lower said first window glass supported on said first regulator arm while said second cam follower will traverse the entire length of said second cam slot during the initial rotation of said sector gear in opposite directions so that upon rotation in the window lowering direction said second cam follower will not be moved along the third cam slot to lower said second window glass section until said first window glass section is lowered by movement of said first cam follower along the straight section of said first cam slot and upon rotation in the window raising direction said second cam follower will not be moved along said third cam slot to raise said second window glass section until said second cam follower traverses the entire length of said second cam slot so that after partial movement of said second cam follower along said third cam slot said first cam follower will enter said straight section of said first cam slot to thereafter raise both window glasses simultaneously.

2. A vehicle window regulator mechanism according to claim 1, wherein said second cam slot further comprises a first straight inclined section continuous with said arcuate section of said second cam slot and extending radially toward the pivot axis of said sector gear, and a second straight inclined section continuous with said arcuate section of said second cam slot at the end thereof opposed to said first straight inclined section.

3. A vehicle window regulator mechanism according to claim 1, wherein a switch means is provided on said base plate, a switch operating projection means provided on said sector gear for operating said switch means when said sector hear has rotated a predetermined amount in the window lowering direction and means for rotating said sector gear in the opposite direction upon energization of said switch means to rotate said sector gear to move said second cam follower from one end of said second cam slot to the opposite end thereof.

4. A vehicle window regulator mechanism according to claim 2, further comprising blocking means for preventing said second cam follower from moving into said arcuate section of said second cam slot and holding said second cam follower in said second straight inclined section of said second cam slot.

5. A vehicle window regulator mechanism according to claim 4, wherein said blocking means comprises a first lever pivotally mounted on said base plate and a second lever pivotally mounted on said sector gear and having a hook portion engageable with said first lever and a cam face engageable with said second cam follower whereby upon rotational movement of said first lever, said second lever is forced to be rotated to be in contact with said second cam follower at said cam face thereby to provent said second cam follower from moving into said arcuate section of said second cam slot.

* * * * *